US011508511B2

(12) United States Patent
Wang et al.

(10) Patent No.: US 11,508,511 B2
(45) Date of Patent: Nov. 22, 2022

(54) COIL DEVICE

(71) Applicant: TDK CORPORATION, Tokyo (JP)

(72) Inventors: Chen Wang, Tokyo (JP); Satoshi Sugimoto, Tokyo (JP); Leo Yao, Lincolnshire, IL (US)

(73) Assignee: TDK CORPORATION, Tokyo (JP)

( * ) Notice: Subject to any disclaimer, the term of this patent is extended or adjusted under 35 U.S.C. 154(b) by 393 days.

(21) Appl. No.: 16/794,444

(22) Filed: Feb. 19, 2020

(65) Prior Publication Data

US 2021/0257145 A1 Aug. 19, 2021

(51) Int. Cl.
*H01F 27/24* (2006.01)
*H01F 27/28* (2006.01)

(52) U.S. Cl.
CPC ..... *H01F 27/24* (2013.01); *H01F 27/28* (2013.01)

(58) Field of Classification Search
CPC ..... H01F 27/24; H01F 27/28
See application file for complete search history.

(56) References Cited

U.S. PATENT DOCUMENTS

| | | | | |
|---|---|---|---|---|
| 9,537,389 | B2 * | 1/2017 | Koji | H01F 41/06 |
| 9,905,354 | B2 * | 2/2018 | Lou | H05K 5/0026 |
| 11,114,992 | B2 * | 9/2021 | Tucker | H02P 27/04 |
| 2017/0178794 | A1 | 6/2017 | Yan et al. | |
| 2020/0067478 | A1 * | 2/2020 | Kim | H01F 37/00 |

* cited by examiner

*Primary Examiner* — Adolf D Berhane
(74) *Attorney, Agent, or Firm* — Oliff PLC

(57) ABSTRACT

A coil device includes a pair of first core and second core, a third core, and a pair of first coil and second coil. The third core is disposed next to the first core or the second core. The pair of first coil and second coil is each disposed between any two of the first core, the second core, and the third core next to each other. Plate surfaces of the first coil and the second coil are opposed to each other. Each of the first coil and the second coil is partly exposed in a lateral direction of the first core, the second core, or the third core.

19 Claims, 17 Drawing Sheets

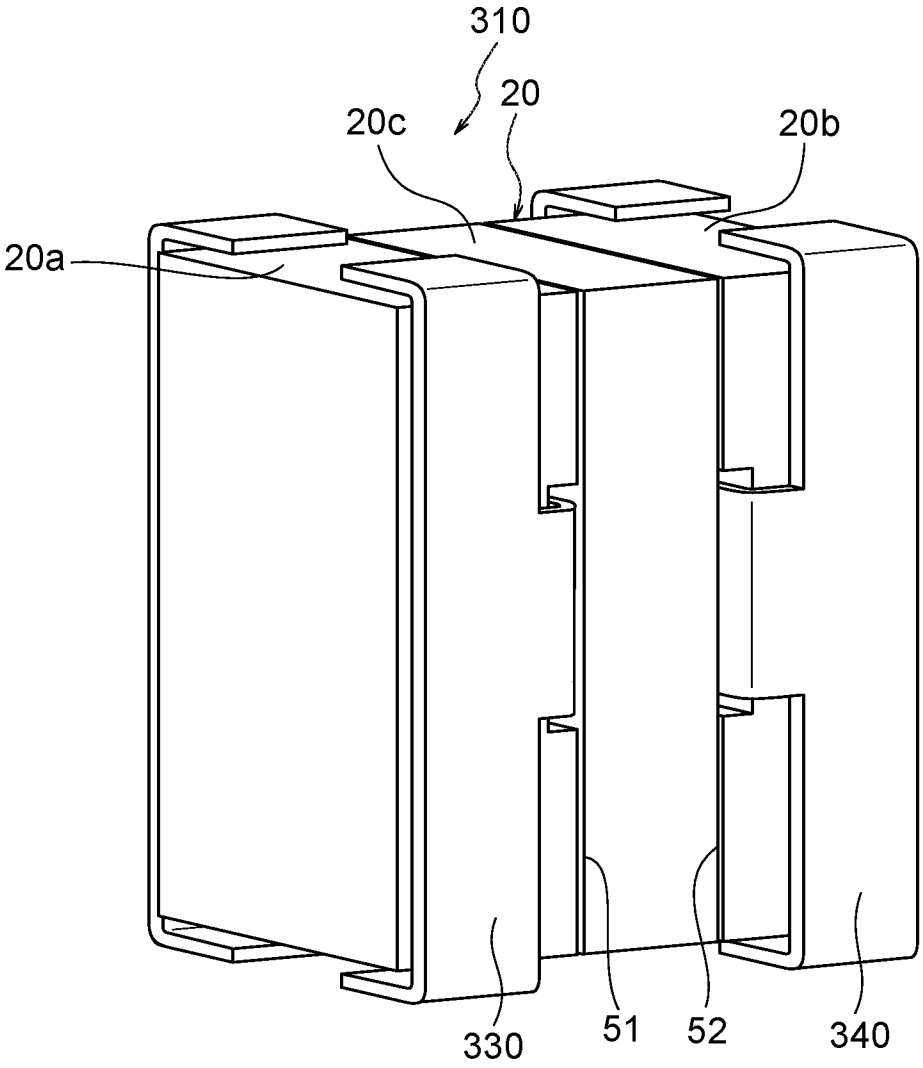
FIG. 7
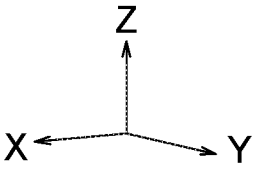

COIL DEVICE

BACKGROUND OF THE INVENTION

The present invention relates to a coil device used as an inductor or so.

As a coil device used as an inductor or so, for example, a coil device of Patent Document 1 is known. The coil device of Patent Document 1 includes a pair of first core and second core and a third core disposed with a gap between the first core and the second core. A first coil is disposed between the first core and the third core, and a second coil is disposed between the second core and the third core. Since a gap is formed between the first core and the third core and between the second core and the third core, the magnetic coupling between the first coil and the second coil can be weak.

In the coil device of Patent Document 1, however, it is difficult to mount mountable parts of the first coil and the second coil on a mounting board with a sufficient mounting strength.

Patent Document 1: US2017178794 (A1)

BRIEF SUMMARY OF INVENTION

The present invention has been achieved under such circumstances. It is an object of the invention to provide a coil device capable of sufficiently maintaining a mounting strength for a mounting board.

To achieve the above object, a coil device according to the present invention includes:

a pair of first core and second core;

a third core disposed next to the first core or the second core; and a pair of first coil and second coil each disposed between any two of the first core, the second core, and the third core next to each other, wherein plate surfaces of the first coil and the second coil are opposed to each other, and wherein each of the first coil and the second coil is partly exposed in a lateral direction of the first core, the second core, or the third core.

In the coil device according to the present invention, each of the first coil and the second coil is partly exposed in a lateral direction of the first core, the second core, or the third core. In mounting the coil device, a solder fillet can thereby partly be formed on the first coil exposed in a lateral direction of any of the cores and the second coil exposed in a lateral direction of any of the cores, and the solder fillets can increase the mounting strength for the mounting board. In the present invention, it is thereby possible to achieve the coil device capable of sufficiently maintaining the mounting strength for the mounting board.

In the coil device according to the present invention, plate surfaces of the first coil and the second coil are opposed to each other. Thus, the first coil is disposed between the cores next to each other while the flat surfaces of the first coil are opposed to a perpendicular direction to the mounting board, and the second coil is disposed between the cores next to each other while the flat surfaces of the second coil are opposed to a perpendicular direction to the mounting board. Thus, the coil device can be thin in the array direction of the first core, the second core, and the third core, and the coil device can be downsized.

Preferably, the first coil includes a pair of plate-like first lateral parts and a plate-like first connection part connecting the pair of first lateral parts, and the second coil includes a pair of plate-like second lateral parts and a plate-like second connection part connecting the pair of second lateral parts. In this structure, the first coil and the second coil can easily be arranged between the cores next to each other, and the coil device is easily manufactured. When the first coil and the second coil have a plate shape, the coil device can be thin in the array direction of the first core, the second core, and the third core, and the coil device can effectively be downsized. Compared to when the first coil and the second coil are formed from wire, a large electric current can flow through the first coil and the second coil.

Preferably, each of the first connection part and the second connection part is disposed between any two of the first core, the second core, and the third core next to each other. Thus, the plate surfaces of the first connection part and the second connection part are arranged to face each other. As a result, the coil device can be thin in the array direction of the first core, the second core, and the third core, and the coil device can effectively be downsized.

Preferably, at least either of the first lateral parts faces a lateral surface of any of the first core, the second core, and the third core, and at least either of the second lateral parts faces a lateral surface of any of the first core, the second core, and the third core. Thus, each of the first lateral part and the second lateral part can widely be exposed to the laterals of any of the first core, the second core, and the third core. Thus, solder fillets can sufficiently be formed on the first lateral part and the second lateral part, and the solder fillets can effectively increase the mounting strength for the mounting board.

Preferably, at least either of the first lateral parts faces lateral surfaces of any two of the first core, the second core, and the third core, and at least either of the second lateral parts faces lateral surfaces of any two of the first core, the second core, and the third core. In this structure, when the coils and the cores are combined in the manufacture of the coil device, any two of the cores can laterally be fixed by the first lateral parts, and any two of the cores can laterally be fixed by the second lateral parts. Thus, the positions of the respective cores can be prevented from being shifted by the first lateral parts and the second lateral parts.

Preferably, at least either of the first lateral parts extends from a lateral surface to a bottom surface of any of the first core, the second core, and the third core, and at least either of the second lateral parts extends from a lateral surface to a bottom surface of any of the first core, the second core, and the third core. In this structure, a part of the first lateral part extending on the bottom surface of any of the cores can be connected as a mounting surface with the mounting board, and a part of the second lateral part extending on the bottom surface of any of the cores can be connected as a mounting surface with the mounting board.

Preferably, at least either of the first lateral parts extends from a lateral surface to a top surface of any of the first core, the second core, and the third core, and at least either of the second lateral parts extends from a lateral surface to a top surface of any of the first core, the second core, and the third core. In this structure, the mounting surface can be formed not only on the bottom surface of the coil device but on the top surface of the coil device. Thus, the coil device can be mounted on the mounting board even if the coil device is upside down (the top surface and the bottom surface are reversed), and the coil device is easily mounted.

Preferably, at least either of the first lateral parts extends from a lateral surface to an end surface of any of the first core, the second core, and the third core, and at least either of the second lateral parts extends from a lateral surface to an end surface of any of the first core, the second core, and the third core. A solder fillet can be formed on a part of the first lateral part located near the end surface of any of the cores, and a solder fillet can be formed on a part of the second lateral part located near the end surface of any of the cores. These solder fillets can increase the mounting strength for the mounting board.

Preferably, the first core, the second core, and the third core are formed to be long in a perpendicular direction to a board surface of a mounting board. In this structure, the width of the coil device can be smaller than the height of the coil device, and a plurality of coil devices can be mounted on the mounting board at high density.

Preferably, the first core has a first concave part through which the first coil passes, the second core has a second concave part through which the second coil passes, and the first concave part or the second concave part is formed to be shifted toward a bottom surface or a top surface of the first core or the second core. In this structure, the magnetic path of the first coil or the second coil can be changed, and magnetic characteristics of the coil device can be adjusted.

Preferably, the coil device further includes "n" number of cores corresponding to the first core or the second core. For example, the coil device having a high inductance value can be obtained by further adding "n" cores ("n" is the number of cores) corresponding to the first core or the second core and correspondingly adding "n" coils ("n" is the number of coils) corresponding to the first coil or the second coil. Even if the number of cores and coils is increased, the coil device can be downsized (space saving) by interposing each of the coils between the cores.

Preferably, any of the first core, the second core, and the third core includes split cores. In this structure, a gap can be formed between the split cores in combining them, and the magnetic coupling between the first coil and the second coil can be adjusted.

Preferably, the first core and the second core are made from magnetic material, and the third core is made from nonmagnetic material. When only the third core is made from nonmagnetic material, for example, the inductance value of the coil device can be adjusted to a desired value.

Preferably, the third core is disposed between the first core and the second core, the first coil is disposed between the first core and the third core, the second coil is disposed between the second core and the third core, the plate surfaces of the first coil and the second coil are opposed to each other with the third core interposed therebetween, the first coil is partly exposed in a lateral direction of the first core, and the second coil is partly exposed in a lateral direction of the second core. In this structure, it is possible to obtain the coil device with symmetry about the third core and favorable magnetic characteristics.

BRIEF DESCRIPTION OF DRAWINGS

FIG. 7 is a perspective view of a coil device according to Fourth Embodiment of the present invention.

DETAILED DESCRIPTION OF INVENTION

Hereinafter, the present invention is explained based on embodiments shown in the figures.

First Embodiment

Figure 1A:
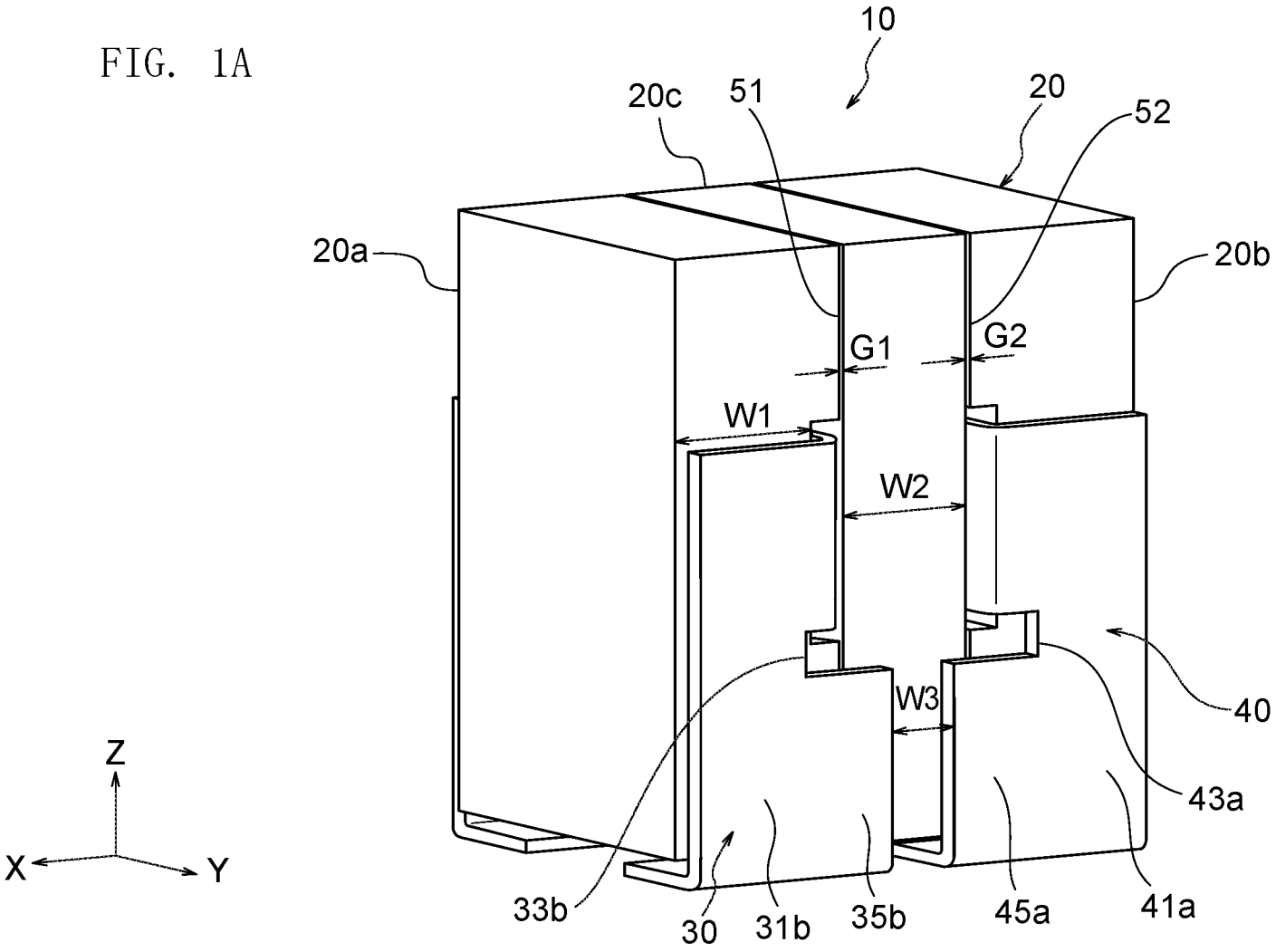
FIG. 1A is a perspective view of a coil device according to First Embodiment of the present invention.

As shown in FIG. 1A, a coil device 10 includes a core 20 having a substantially rectangular parallelepiped outer shape as a whole and a pair of first coil 30 and second coil 40 at least partly arranged in the core 20. The coil device 10 is, for example, an inductor and has an array structure where the coils 30 and 40 are arrayed in the X-axis direction along with cores 20*a*, 20*b*, and 20*c* mentioned below. The coil device 10 has any size. For example, the coil device 10 can appropriately have a length of 3-20 mm in each of the X-axis direction, the Y-axis direction, and the Z-axis direction.

The core 20 is formed from a pair of first core 20*a* and second core 20*b* and a third core 20*c* disposed next to the first core 20*a* and the second core 20*b* in the X-axis direction. The core 20 is made from a magnetic material and is manufactured by, for example, molding and sintering a magnetic material having a comparatively high permeability (e.g., Ni—Zn based ferrite, Mn—Zn based ferrite) or a magnetic powder composed of a metal magnetic material or so. Incidentally, the core 20*c* may be made from a nonmagnetic material or a green compact containing a magnetic powder in resin. The cores 20*a*, 20*b*, and 20*c* may have mutually different permeabilities.

Figure 2:
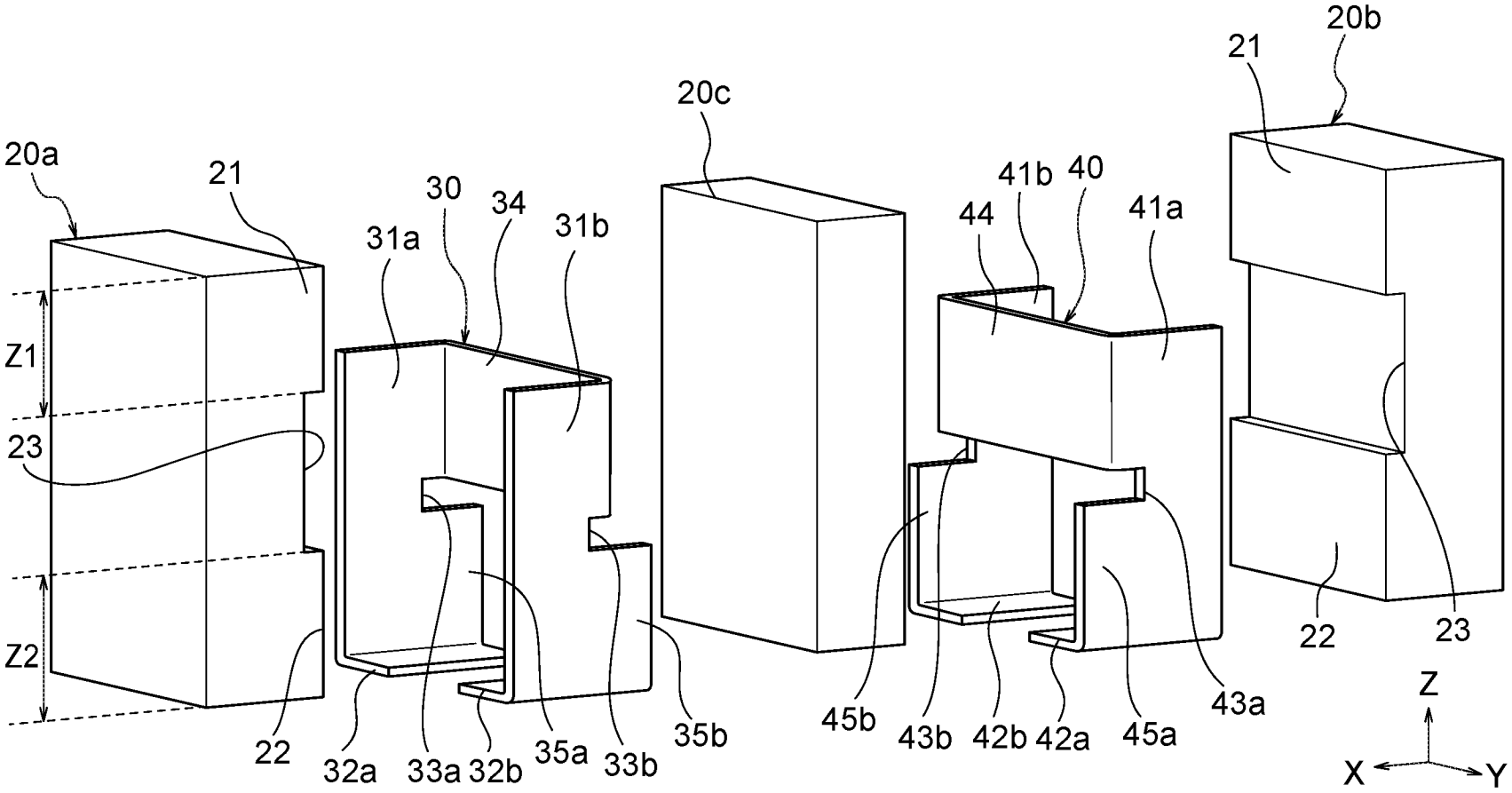
FIG. 2 is an exploded perspective view of the coil device shown in FIG. 1A.

The first core 20*a* and the second core 20*b* have a mutually corresponding (symmetrical) shape. In the illustrated example, the first core 20*a* and the second core 20*b* have the same shape. As shown in FIG. 2, the core 20*a* (20*b*) has a substantially rectangular parallelepiped shape being longer in the Z-axis direction (the height direction of the coil device 10 or the perpendicular direction to the board surface of the mounting board) and is formed from a C-shaped or U-shaped core. The core 20*a* (20*b*) has a first outer leg part 21, a second outer leg part 22, and a concave part 23.

The first outer leg part 21 is formed at the upper end of the core 20*a* (20*b*) in the Z-axis direction, and the second outer leg part 22 is formed at the lower end of the core 20*a* (20*b*) in the Z-axis direction. The length Z1 of the first outer leg part 21 in the Z-axis direction and the length Z2 of the second outer leg part 22 in the Z-axis direction are equal to each other, but Z2>Z1 may be accepted. In this case, the position of the concave part 23 can be shifted toward the top surface of the core 20*a* (20*b*), and magnetic saturation of the coil device 10 can effectively be prevented. Z2<Z1 may also be accepted. In this case, since the position of the concave part 23 can be shifted toward the bottom surface of the core 20*a* (20*b*), the coil 30 becomes shorter (particularly, a length of a first lateral part 31*a* (31*b*) mentioned below in the Z-axis direction), and DC resistance of the coil 30 can correspondingly be lowered. The first outer leg parts 21 and 22 of the first core 20*a* are projecting toward one side in the X-axis direction, and the first outer leg parts 21 and 22 of the second core 20*b* are projecting toward the other side in the X-axis direction.

The concave part 23 is formed between the first outer leg part 21 and the first outer leg part 22. The width of the concave part 23 in the Z-axis direction is substantially equal to or larger than a width of a connection part 34 (44) of the coil 30 (40) mentioned below. The depth of the concave part 23 in the X-axis direction is substantially equal to or larger than a thickness of the coil 30 (40) (board thickness) mentioned below. As shown in FIG. 1A and FIG. 2, a ratio W2/W1 of a width W2 of the third core 20*c* in the X-axis direction to a width W1 of the first core 20*a* in the X-axis direction at the concave part 23 is preferably 0.5-1 (more preferably, 1). A cross-sectional area of the first core 20*a* in cutting it on a perpendicular plane to the Z-axis at the concave part 23 is smaller than that at another part.

The first core 20*a* and the third core 20*c* are combined by bonding at least either of the outer leg parts 21 and 22 of the first core 20*a* and an end surface (front surface) of the third core 20*c* on the other side in the X-axis direction with a bonding material (e.g., adhesive). The second core 20*b* and the third core 20*c* are combined by bonding at least either of the outer leg parts 21 and 22 of the second core 20*b* and an end surface (front surface) of the third core 420*c* on one side in the X-axis direction with a bonding material (e.g., adhesive).

For example, when a Micropearl (Sekisui Chemical Co., Ltd.) or a resin containing resin beads is used, a first gap 51 (see FIG. 1A) mentioned below can easily be formed between the first core 20*a* and the third core 20*c*, and a second gap 52 (see FIG. 1A) mentioned below can easily be formed between the second core 20*b* and the third core 20*c*.

In a state where the cores 20*a*, 20*b*, and 20*c* are combined, the first gap 51 is formed in the Z-axis direction between the outer leg parts 21 and 22 of the first core 20*a* and the end surface of the third core 20*c*, and the second gap 52 is formed in the Z-axis direction between the outer leg parts 21 and 22 of the second core 20*b* and the end surface of the third core 20*c*. Preferably, each of the width G1 of the first gap 51 in the X-axis direction and the width G2 of the second gap 52 in the X-axis direction is 0.03-0.3 mm. Incidentally, the width G1 and the width G2 may be different from each other.

Due to the first gap 51 formed between the first core 20*a* and the third core 20*c* and the second gap 52 formed between the second core 20*b* and the third core 20*c*, magnetic coupling between the first coil 30 and the second coil 40 can effectively be prevented.

As shown in FIG. 2, the concave part 23 is formed at a substantially central part of the core 20*a* (20*b*) in the Z-axis direction. The connection part 34 of the first coil 30 can be inserted into (pass through) the concave part 23 of the first core 20*a*. The connection part 44 of the second coil 40 can be inserted into (pass through) the concave part 23 of the second core 20*b*.

The third core 20*c* has a rectangular parallelepiped shape being longer in the Z-axis direction and is formed from an I-shaped (flat shape) core. The third core 20*c* is disposed to be interposed by the first core 20*a* and the second core 20*b* in the X-axis direction. While the third core 20*c* is interposed, the second core 20*b* is disposed outside the second coil 40 disposed on one side in the X-axis direction, and the first core 20*a* is disposed outside the first coil 30 disposed on the other side in the X-axis direction.

The first coil 30 and the second coil 40 have a mutually corresponding (symmetrical) shape. In the illustrated example, the first coil 30 and the second coil 40 have the same shape. The second coil 40 is what the first coil 30 is rotated around the Z-axis by 180 degrees.

For example, the coils 30 and 40 are made from a metal good conductor of copper, copper alloy, silver, nickel, etc., but may be made from any other conductor material. For example, the coils 30 and 40 are formed by machining a metal plate (conductor plate), but the coils 30 and 40 may be formed by any other method. In the illustrated example, the coil 30 (40) has a substantially U shape as a whole and is longer in the Y-axis direction than in the X-axis direction and in the Z-axis direction. That is, the coil 30 (40) has a shape being longer in the Z-axis direction.

At least a part of the first coil 30 is disposed between the first core 20*a* and the third core 20*c* next to each other, and at least a part of the second coil 40 is disposed between the second core 20*b* and the third core 20*c* next to each other. The first coil 30 has a pair of first lateral parts 31*a* and 31*b*, a pair of first concave parts 33*a* and 33*b*, and a first connection part 34.

The first lateral part 31*a* (31*b*) has a plate shape (flat shape) parallel to the XZ plane and is longer in the Z-axis direction. The first lateral part 31*a* (31*b*) extends downward in the Z-axis direction from the first connection part 34. The first lateral parts 31*a* and 31*b* are opposed to each other with a predetermined distance in the Y-axis direction. The distance between the first lateral part 31*a* and the first lateral part 31*b* is substantially equal to or larger than the width of the core 20 in the Y-axis direction. A space (clearance) may be formed between the first lateral part 31*a* (31*b*) and the lateral surface of the core 20 (the lateral surface in the Y-axis direction). Instead, the lateral surfaces of the core 20 may be interposed by the first lateral parts 31*a* and 31*b*.

The first lateral part 31*a* (31*b*) has a first mountable part 32*a* (32*b*) and a first lateral protrusion part 35*a* (35*b*). The first lateral protrusion part 35*a* (35*b*) has a plate shape (flat shape) parallel to the XZ plane and extends in the Z-axis direction from a substantially central part to the lower end of the first lateral part 31*a* (31*b*) in the Z-axis direction. The first lateral protrusion part 35*a* (35*b*) is more projecting than the first connection part 34 in the X-axis direction (toward one side in the X-axis direction). Incidentally, the first lateral protrusion part 35*a* (35*b*) corresponds to a part of the first lateral part 31*a* (31*b*) that is more projecting than the base (bottom) of the first concave part 33*a* (33*b*) mentioned below toward one side in the X-axis direction. The part of the first lateral part 31*a* (31*b*) excluding the first lateral protrusion part 35*a* (35*b*) is a main part of the first lateral part 31*a* (31*b*).

As shown in FIG. 1A, the first lateral protrusion part 35*a* (35*b*) (the first lateral protrusion part 35*a* is not illustrated, though) is disposed at the lower ends of the first core 20*a* and the third core 20*c* in the Z-axis direction so as to range over the lateral surfaces of the cores 20*a* and 20*c* in the X-axis direction. That is, the lateral surfaces of the cores 20*a* and 20*c* are at least partly covered with the first lateral protrusion part 35*a* (35*b*) at the lower ends of the cores 20*a* and 20*c*.

A space is formed between the end of the first lateral part 31*a* (31*b*) on the other side (positive side) in the X-axis direction and the end surface of the first core 20*a* on the other side in the X-axis direction. That is, the first lateral part 31*a* (31*b*) does not extend to the end surface of the first core 20*a* on the other side in the X-axis direction, but only extends to the inner side of this end surface.

In the present embodiment, the first coil 30 is partly (first lateral parts 31*a* and 31*b*) exposed (arranged) to the lateral (outside) of the first core 20*a* and the third core 20*c* in the Y-axis direction. The first lateral part 31*a* (31*b*) (including the first lateral protrusion part 35*a* (35*b*)) is opposed to the lateral surfaces of the first core 20*a* and the third core 20*c*. As a result, the first core 20*a* and the third core 20*c* are arranged to be interposed in the Y-axis direction by the first lateral parts 31*a* and 31*b* (including the first lateral protrusion parts 35*a* and 35*b*) laterally exposed in the Y-axis direction.

As shown in FIG. 2, the first mountable part 32*a* (32*b*) has a plate shape (flat shape) parallel to the XY plane and is longer in the X-axis direction (the longitudinal direction of the coil device 10). For example, the first mountable part 32*a* (32*b*) is formed by bending the first lateral part 31*a* (31*b*) from the Z-axis direction to the Y-axis direction at a substantially right angle. As shown in FIG. 1A, a space is formed between the first mountable part 32*a* (32*b*) and the core 20 in the Z-axis direction. In the present embodiment, the first lateral part 31*a* (31*b*) thereby extends from the lateral surfaces to the bottom surfaces of the first core 20*a* and the third core 20*c* via the first mountable part 32*a* (32*b*).

Figure 1B:
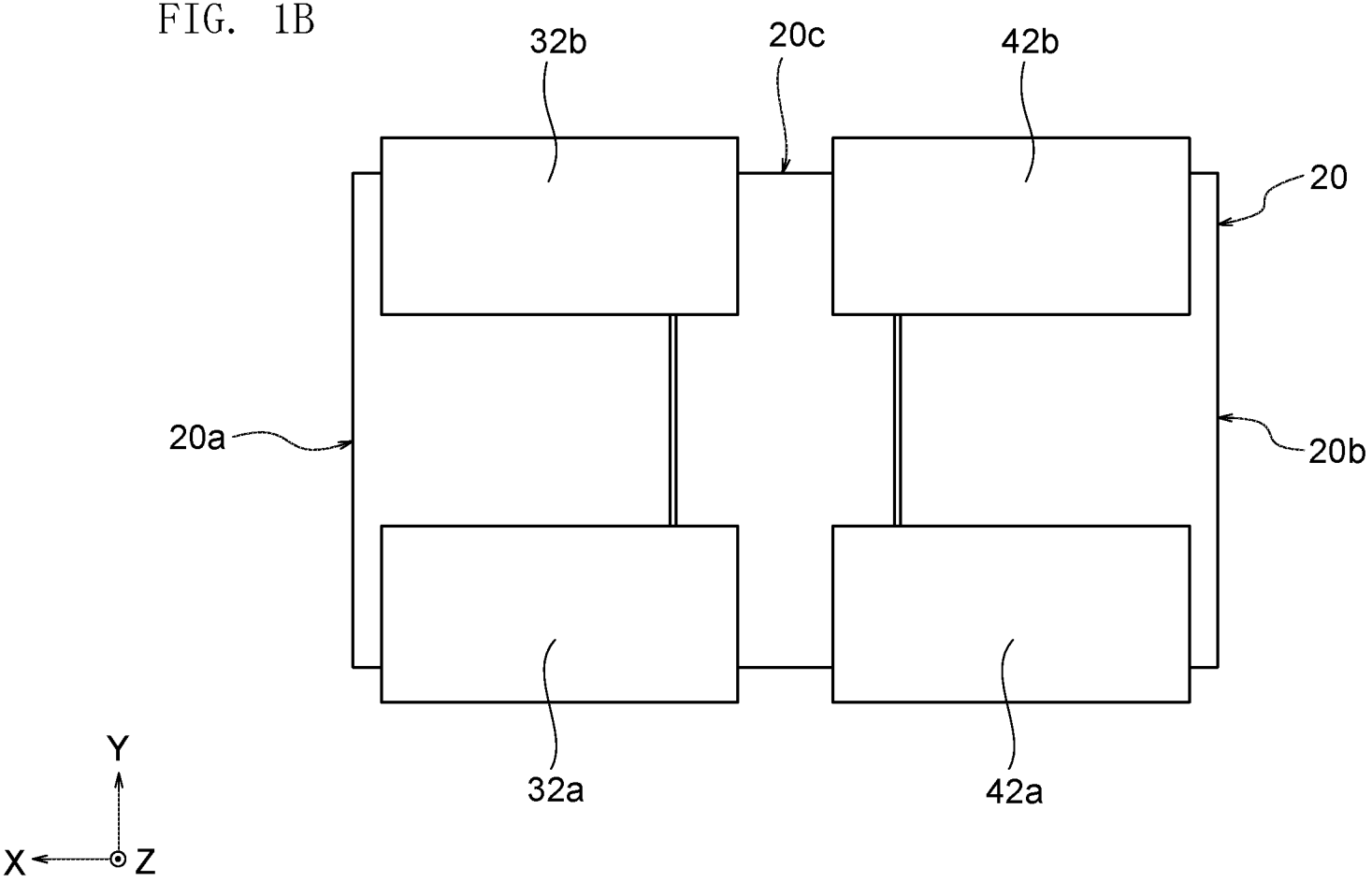
FIG. 1B is a bottom view of the coil device shown in FIG. 1A.

As shown in FIG. 1B, the first mountable parts 32*a* and 32*b* extend toward the inner side in the Y-axis direction so as to approach each other on the bottom side of the core 20. The first mountable parts 32*a* and 32*b* are arranged to range over the bottom surfaces of the cores 20*a* and 20*c*.

A space is formed between the end of the first mountable part 32*a* (32*b*) on the positive side in the X-axis direction and the end surface of the first core 20*a* on the positive side in the X-axis direction. That is, the first mountable part 32*a* (32*b*) does not extend to the end surface of the first core 20*a* on the positive side in the X-axis direction, but extends only to the inner side of this end surface.

The first mountable part 32*a* (32*b*) is connected with a land pattern of the mounting board by a bonding material of solder, conductive adhesive, etc., and the coil device 10 can be connected with the mounting board via the first mountable parts 32*a* and 32*b*. At this time, a solder fillet can be formed on the outer surface of the first lateral part 31*a* (31*b*) in the Y-axis direction.

As shown in FIG. 2, the first connection part 34 has a plate shape (flat shape) parallel to the YZ plane and is longer in the Y-axis direction (the width direction of the coil device 10). The first connection part 34 is disposed to face the surfaces (flat surfaces) of the first core 20*a* and the third core 20*c*. The first connection part 34 connects the pair of first lateral parts 31*a* and 31*b* in the surroundings of the upper ends of the first lateral parts 31*a* and 31*b* on one end in the X-axis direction. The first connection part 34 and the pair of first lateral parts 31*a* and 31*b* are substantially perpendicular to each other. The first connection part 34 is disposed between the first core 20*a* and the third core 20*c* next to each other.

The first concave part 33*a* (33*b*) is formed at a substantially central part in the Z-axis direction on one end of the first lateral part 31*a* (31*b*) in the X-axis direction. The first concave part 33*a* (33*b*) is dented toward the other side in the X-axis direction. Due to the first concave part 33*a* (33*b*), the first lateral part 31*a* (31*b*) has a locally small width in the X-axis direction. As shown in FIG. 1A, the lateral of the first core 20*a* in the Y-axis direction is locally exposed at the position of the first concave part 33*a* (33*b*) (the first concave part 33*a* is not illustrated, though).

As shown in FIG. 2, the second coil 40 has a pair of plate-like second lateral parts 41*a* and 41*b*, a pair of second concave parts 43*a* and 43*b*, and a plate-like second connection part 44 connecting the pair of second lateral parts 41*a* and 41*b*. The second lateral part 41*a* (41*b*) has a second lateral protrusion part 45*a* (45*b*) and a second mountable part 42*a* (42*b*). Since the structure of each part of the second coil 40 is similar to that of the first coil 30 mentioned above, their overlapping matters are not explained in detail.

As shown FIG. 1A, the second lateral protrusion part 45*a* (45*b*) (the second lateral protrusion part 45*b* is not illustrated, though) is disposed at the lower ends of the second core 20*b* and the third core 20*c* in the Z-axis direction so as to range over the lateral surfaces of the cores 20*b* and 20*c* in the X-axis direction. That is, the lateral surfaces of the cores 20*b* and 20*c* are at least partly covered with the second lateral protrusion part 45*a* (45*b*) at the lower ends of the cores 20*b* and 20*c*.

Although not illustrated in detail, a space is formed between the end of the second lateral part 41*a* (41*b*) on one side (negative side) in the X-axis direction and the end surface of the second core 20*b* on one side in the X-axis direction. That is, the second lateral part 41*a* (41*b*) does not extend to the end surface of the second core 20*b* on one side in the X-axis direction, but extends only to the inner side of this end surface.

In the present embodiment, the second coil 40 is partly (second lateral parts 41*a* and 41*b*) exposed (arranged) to the lateral (outside) of the second core 20*b* and the third core 20*c* in the Y-axis direction. The second lateral part 41*a* (41*b*) (including the second lateral protrusion part 45*a* (45*b*)) is opposed to the lateral surfaces of the second core 20*b* and the third core 20*c*. As a result, the second core 20*b* and the third core 20*c* are arranged to be interposed in the Y-axis direction by the second lateral parts 41*a* and 41*b* (including the second lateral protrusion parts 45*a* and 45*b*) laterally exposed in the Y-axis direction.

As shown in FIG. 1B, the second mountable part 42*a* (42*b*) is disposed to range over the bottom surfaces of the cores 20*b* and 20*c* in the X-axis direction. A space is formed between the end of the second mountable part 42*a* (42*b*) on the negative side in the X-axis direction and the end surface of the second core 20*b* on the negative side in the X-axis direction. That is, the second lateral part 42*a* (42*b*) does not extend to the end surface of the second core 20*b* in the X-axis direction, but extends only to the inner side of this end surface.

In the present embodiment, as shown in FIG. 1A, the second lateral part 41*a* (41*b*) extends from the lateral surfaces to the bottom surfaces of the second core 20*b* and the third core 20*c* via the second mountable part 42*a* (42*b*). The second connection part 44 is disposed between the second core 20*b* and the third core 20*c* next to each other and is disposed to face the surfaces (flat surfaces) of the second core 20*b* and the third core 20*c*.

The plate surfaces of the first core 30 and the second coil 40 are opposed to each other in the X-axis direction. For more detail, as shown in FIG. 2, the first connection part 34 of the first coil 30 is opposed to the second connection part 44 of the second coil 40 with the third core 20*c* interposed therebetween in the X-axis direction. The first connection part 34 is disposed between the first core 20*a* and the third core 20*c* arranged next to each other, and the second connection part 44 is disposed between the second core 20*b* and the third core 20*c* arranged next to each other. As shown in FIG. 1A and FIG. 2, the distance between the first connection part 34 and the second connection part 44 in the X-axis direction is substantially equal to or larger than the length of the third core 20*c* in the X-axis direction.

As shown in FIG. 1A, the first lateral protrusion part 35*b* (35*a*) and the second lateral protrusion part 45*a* (45*b*) are arranged with a distance in the X-axis direction. Preferably, the ratio W3/W2 of the distance W3 between the first lateral protrusion part 35*b* (35*a*) and the second lateral protrusion part 45*a* (45*b*) in the X-axis direction to the width W2 of the third core 20*c* in the X-axis direction is 0.1-0.8 (more preferably, 0.3-0.5).

In the manufacture of the coil device 10, prepared are the cores 20*a*, 20*b*, and 20*c*, the first coil 30, and the second coil 40 shown in FIG. 1A. Then, the cores 20*a*, 20*b*, and 20*c* are combined while the coils 30 and 40 are contained. At this time, as shown in FIG. 2, the first coil 30 is interposed by the first core 20*a* and the third core 20*c* so that the first connection part 34 is inserted into the concave part 23 of the first core 20*a*, and the second coil 40 is interposed by the second core 20*b* and the third core 20*c* so that the second connection part 44 is inserted into the concave part 23 of the second core 20*b*. The coils 30 and 40 may be fixed to the cores 20*a*, 20*b*, and 20*c* with adhesive or so.

Next, the first outer leg part 21 and/or the second outer leg part 22 of the first core 20*a* and the flat surface of the third core 20*c* on the other side in the X-axis direction are bonded with adhesive or so, and the first outer leg part 21 and/or the second outer leg part 22 of the second core 20*b* and the flat surface of the third core 20*c* on one side in the X-axis direction are bonded with adhesive or so. Then, the coil device 10 shown in FIG. 1A is obtained.

In the coil device 10 according to the present embodiment, the first coil 30 is partly (first lateral part 31*a* (31*b*)) exposed to the laterals of the cores 20*a* and 20*c*, and the second coil 40 is partly (second lateral part 41*a* (41*b*)) exposed to the laterals of the cores 20*b* and 20*c*. In mounting the coil device 10, a solder fillet can thereby be formed on each of the first lateral part 31*a* (31*b*) exposed to the laterals of the cores 20*a* and 20*c* and the second lateral part 41*a* (41*b*) exposed to the laterals of the cores 20*b* and 20*c*, and the solder fillets can increase the mounting strength for the mounting board. In the present embodiment, it is thereby possible to achieve the coil device 10 capable of sufficiently maintaining the mounting strength for the mounting board.

In the coil device 10 according to the present embodiment, the plate surfaces of the first coil 30 (first connection part 34) and the second coil 40 (second connection part 44) are opposed to each other. Thus, the first coil 30 is disposed between the cores 20*a* and 20*c* next to each other while the flat surfaces of the first coil 30 are opposed to a perpendicular direction to the mounting board, and the second coil 40 is disposed between the cores 20*b* and 20*c* next to each other while the flat surfaces of the second coil 40 are opposed to a perpendicular direction to the mounting board. Thus, the coil device 10 can be thin in the array direction of the first core 20*a*, the second core 20*b*, and the third core 20*c*, and the coil device 10 can be downsized.

In the present embodiment, the first coil 30 has the pair of first lateral parts 31*a* and 31*b* and the first connection part 34, and the second coil 40 has the pair of second lateral parts 41*a* and 41*b* and the second connection part 44. Thus, the first coil 30 is easily disposed between the cores 20*a* and 20*c* next to each other, the second coil 40 is easily disposed between the cores 20*b* and 20*c* next to each other, and the coil device 10 is easily manufactured. Since the first coil 30 and the second coil 40 have a plate shape, the coil device 10 can be thin in the array direction of the first core 20*a*, the second core 20*b*, and the third core 20*c*, and the coil device 10 can effectively be downsized. Compared to when the first coil 30 and the second coil 40 are formed from wire, a large electric current can flow through the first coil 30 and the second coil 40.

In the present embodiment, the first connection part 34 is disposed between the first core 20*a* and the third core 20*c* next to each other, and the second connection part 44 is disposed between the second core 20*b* and the third core 20*c* next to each other. Thus, the plate surfaces of the first connection part 34 and the second connection part 44 are arranged to face each other. As a result, the coil device 10 can be thin in the array direction of the first core 20*a*, the second core 20*b*, and the third core 20*c*, and the coil device 10 can effectively be downsized.

In the present embodiment, the first lateral part 31*a* (31*b*) is opposed to the lateral surfaces of the first core 20*a* and the third core 20*c*, and the second lateral part 41*a* (41*b*) is opposed to the lateral surfaces of the second core 20*b* and the third core 20*c*. Thus, the first lateral part 31*a* (31*b*) can widely be exposed to the laterals of the first core 20*a* and the third core 20*c*, and the second lateral part 41*a* (41*b*) can widely be exposed to the laterals of the second core 20*b* and the third core 20*c*. Thus, solder fillets can sufficiently be formed on the first lateral part 31*a* (31*b*) and the second lateral part 41*a* (41*b*), and the solder fillets can effectively increase the mounting strength for the mounting board.

When the coils 30 and 40 and the cores 20*a*, 20*b*, and 20*c* are combined in the manufacture of the coil device 10, the cores 20*a* and 20*c* can laterally be fixed by the first lateral parts 31*a* and 31*b*, and the cores 20*b* and 20*c* can laterally be fixed by the second lateral parts 41*a* and 41*b*. Thus, the positions of the respective cores 20*a*, 20*b*, and 20*c* can be prevented from being shifted by the first lateral parts 31*a* and 31*b* and the second lateral parts 41*a* and 41*b*.

In the present embodiment, the first lateral part 31*a* (31*b*) extends from the lateral surfaces to the bottom surfaces of the first core 20*a* and the third core 20*c*, and the second lateral part 41*a* (41*b*) extends from the lateral surfaces to the bottom surfaces of the second core 20*b* and the third core 20*c*. Thus, a part of the first lateral part 31*a* (31*b*) extending on the bottom surface of the core 20*a* (20*b*) (mountable part 32*a* (32*b*)) can be connected as a mounting surface with the mounting board, and a part of the second lateral part 41*a* (41*b*) extending on the bottom surface of the core 20*b* (20*c*) (mountable part 42*a* (42*b*)) can be connected as a mounting surface with the mounting board.

In the present embodiment, the first core 20*a*, the second core 20*b*, and the third core 20*c* are formed to be longer perpendicularly to the board surface of the mounting board. Thus, the width of the coil device 10 can be smaller than the height of the coil device 10, and a plurality of coil devices 10 can be mounted on the mounting board at high density.

In the present embodiment, the third core 20*c* is disposed between the first core 20*a* and the second core 20*b*; the first coil 30 is disposed between the first core 20*a* and the third core 20*c*; the second coil 40 is disposed between the second core 20*b* and the third core 20*c*; the plate surfaces of the first coil 30 (connection part 34) and the second coil 40 (connection part 44) are opposed to each other with the third core 20*c* interposed therebetween; the first coil 30 is partly (first lateral parts 31*a* and 31*b*) exposed to the lateral of the first core 20*a*; and the second coil 40 is partly (second lateral parts 41*a* and 41*b*) exposed to the lateral of the second core 20*b*. It is thereby possible to obtain the coil device 10 with symmetry about the third core 20*c* and favorable magnetic characteristics.

Second Embodiment

Except for the following matters, a coil device 110 according to Second Embodiment of the present invention is similar to the coil device 10 according to First Embodiment and demonstrates similar effects. Their overlapping matters are not explained. In the figures, common members are provided with common references.

Figure 3A:
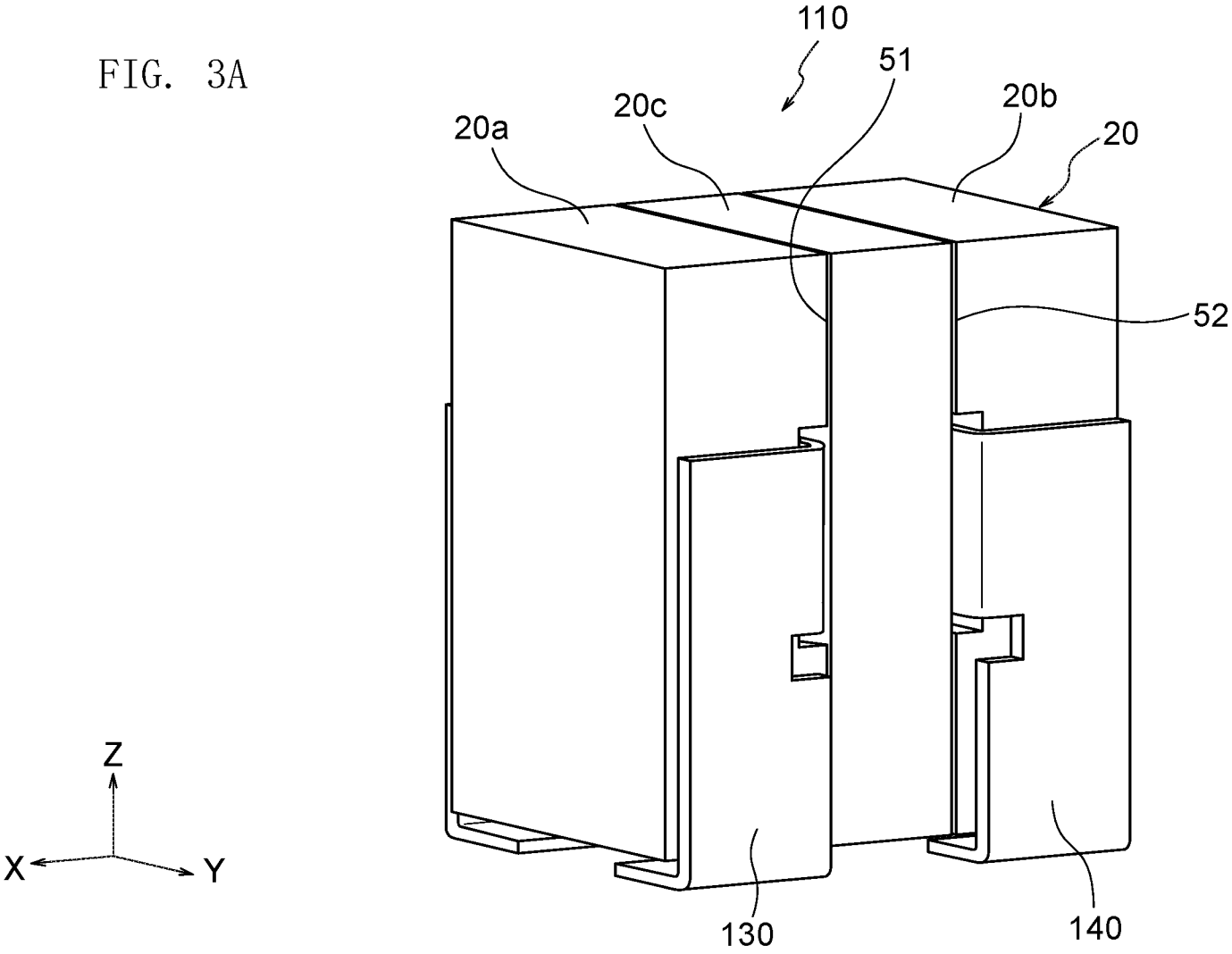
FIG. 3A is a perspective view of a coil device according to Second Embodiment of the present invention.
Figure 4:
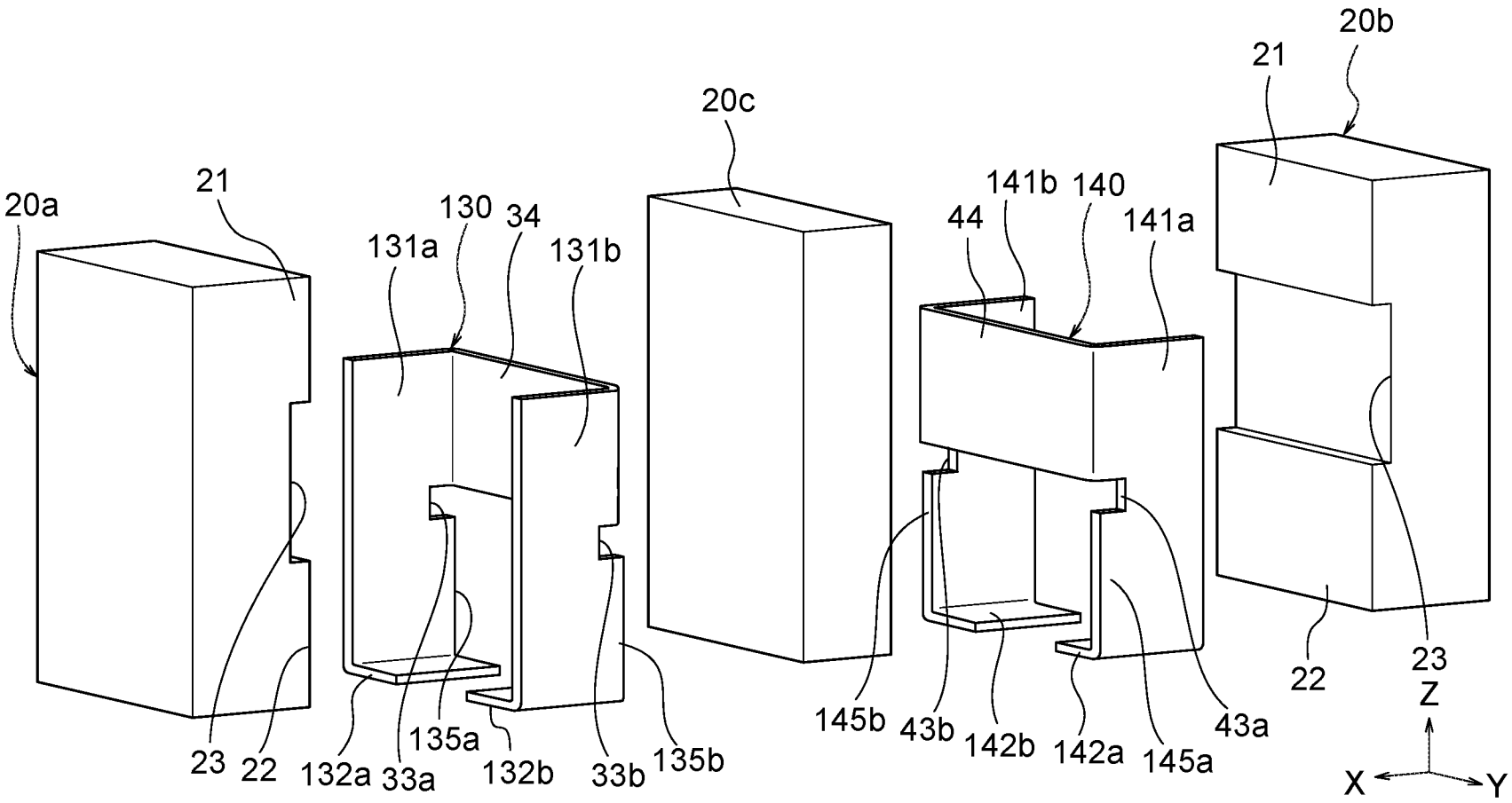
FIG. 4 is an exploded perspective view of the coil device shown in FIG. 3A.

As shown in FIG. 3A, the coil device 110 includes a first coil 130 and a second coil 140. As shown in FIG. 4, the first coil 130 has first lateral parts 131*a* and 131*b*, and the first lateral part 131*a* (131*b*) has a first lateral protrusion part 135*a* (135*b*) and a first mountable part 132*a* (132*b*).

As clearly shown in comparison between FIG. 4 and FIG. 2, the first lateral protrusion part 135*a* (135*b*) is different from the first lateral protrusion part 35*a* (35*b*) of First Embodiment in that the first lateral protrusion part 135*a* (135*b*) has a small protrusion length on one side in the X-axis direction.

For more detail, the protrusion length of the first lateral protrusion part 135*a* (135*b*) from the base of the first concave part 33*a* (33*b*) shown in FIG. 4 is a substantially half of that of the first lateral protrusion part 35*a* (35*b*) from the base of the first concave part 33*a* (33*b*) shown in FIG. 2. The first lateral protrusion part 135*a* (135*b*) protrudes to substantially the same position as the connection part 34 on one side in the X-axis direction.

In the present embodiment, as shown in FIG. 3A and FIG. 4, the first lateral protrusion part 135*a* (135*b*) is not thereby disposed to range over the lateral surfaces of the first core 20*a* and the third core 20*c* at the lower ends of the cores 20*a* and 20*c* in the Z-axis direction, but is disposed only on the lateral surface of the first core 20*a*. The position of the end of the first lateral protrusion part 135*a* (135*b*) on one side in the X-axis direction (negative side in the X-axis direction) is substantially the same as that of the second outer leg part 22 on one side in the X-axis direction.

The first mountable part 132*a* (132*b*) is different from the first mountable part 32*a* (32*b*) of First Embodiment in that the first mountable part 132*a* (132*b*) has a smaller length in the X-axis direction. In the present embodiment, as mentioned above, the first lateral protrusion part 135*a* (135*b*) has a smaller protrusion length on one side in the X-axis direction, and the first lateral part 131*a* (131*b*) thereby has a smaller length in the X-axis direction. Thus, the length of the first mountable part 132*a* (132*b*) in the X-axis direction is correspondingly smaller than that of the first mountable part 32*a* (32*b*) of First Embodiment.

The second coil 140 has second lateral parts 141*a* and 141*b*, and the second lateral part 141*a* (141*b*) has a second lateral protrusion part 145*a* (145*b*) and a second mountable part 142*a* (142*b*). The structure of each part of the second lateral part 141*a* (141*b*) is similar to that of the first lateral part 131*a* (131*b*). Thus, their overlapping matters are not explained in detail.

As shown in FIG. 3A and FIG. 4, the second lateral protrusion part 145*a* (145*b*) is not disposed to range over the lateral surfaces of the second core 20*b* and the third core 20*c* at the lower ends of the cores 20*b* and 20*c* in the Z-axis direction, but is disposed only on the lateral surface of the second core 20*b*. The position of the end of the second lateral protrusion part 145*a* (145*b*) on the other side in the X-axis direction (positive side in the X-axis direction) is substantially the same as that of the second outer leg part 22 on the other side in the X-axis direction.

Effects similar to those of First Embodiment are obtained in the present embodiment. In addition, each of the first lateral protrusion part 135*a* (135*b*) and the second lateral protrusion part 145*a* (145*b*) has a comparatively small protrusion length in the X-axis direction in the present embodiment. Thus, the distance between the first lateral protrusion part 135*b* (135*a*) and the second lateral protrusion part 145*a* (145*b*) in the X-axis direction is large, and the generation of short circuit failure therebetween can be prevented.

Third Embodiment

Except for the following matters, a coil device 210 according to Third Embodiment of the present invention is similar to the coil device 110 according to Second Embodiment and demonstrates similar effects. Their overlapping matters are not explained. In the figures, common members are provided with common references.

Figure 5A:
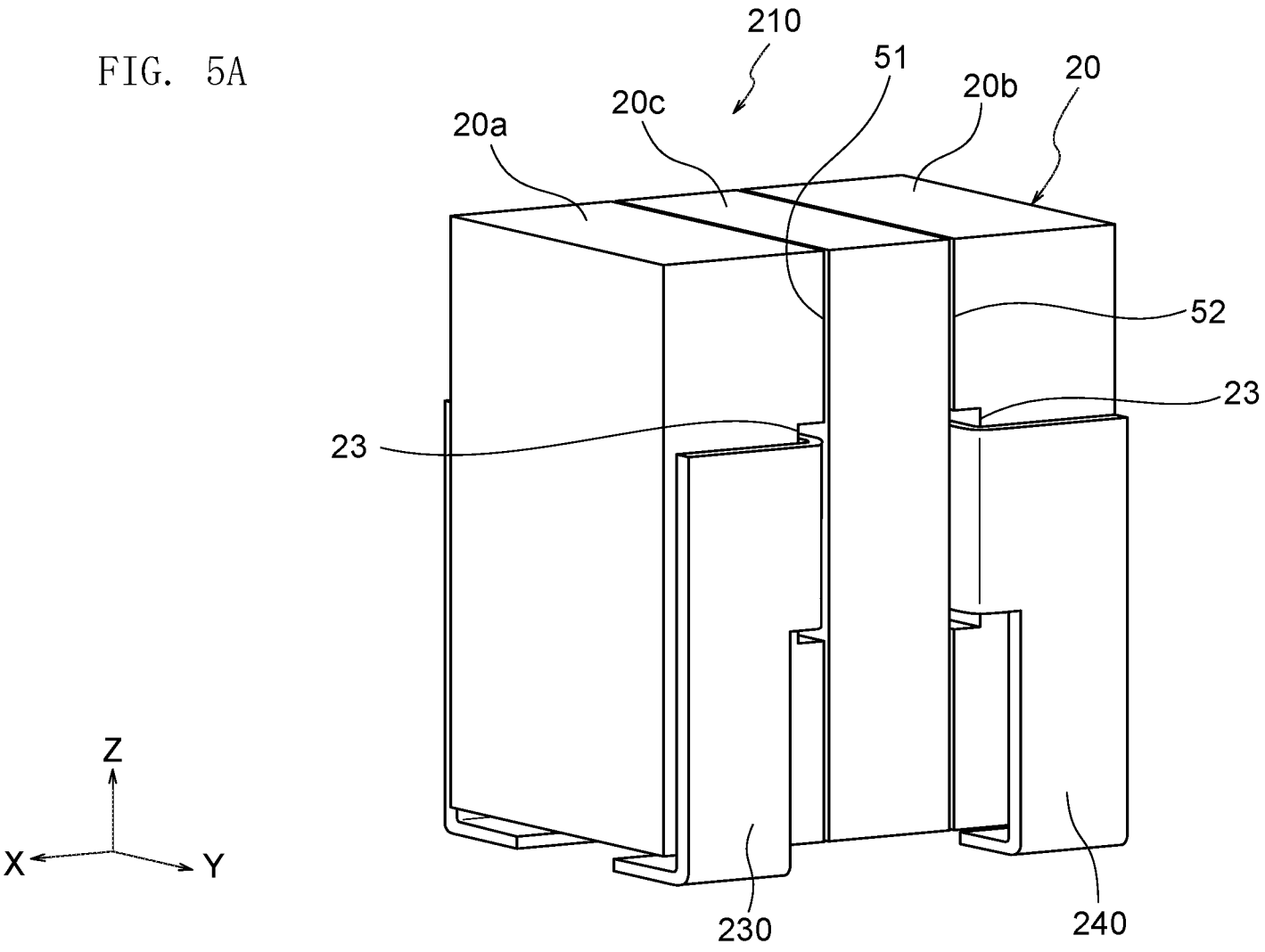
FIG. 5A is a perspective view of a coil device according to Third Embodiment of the present invention.
Figure 6:
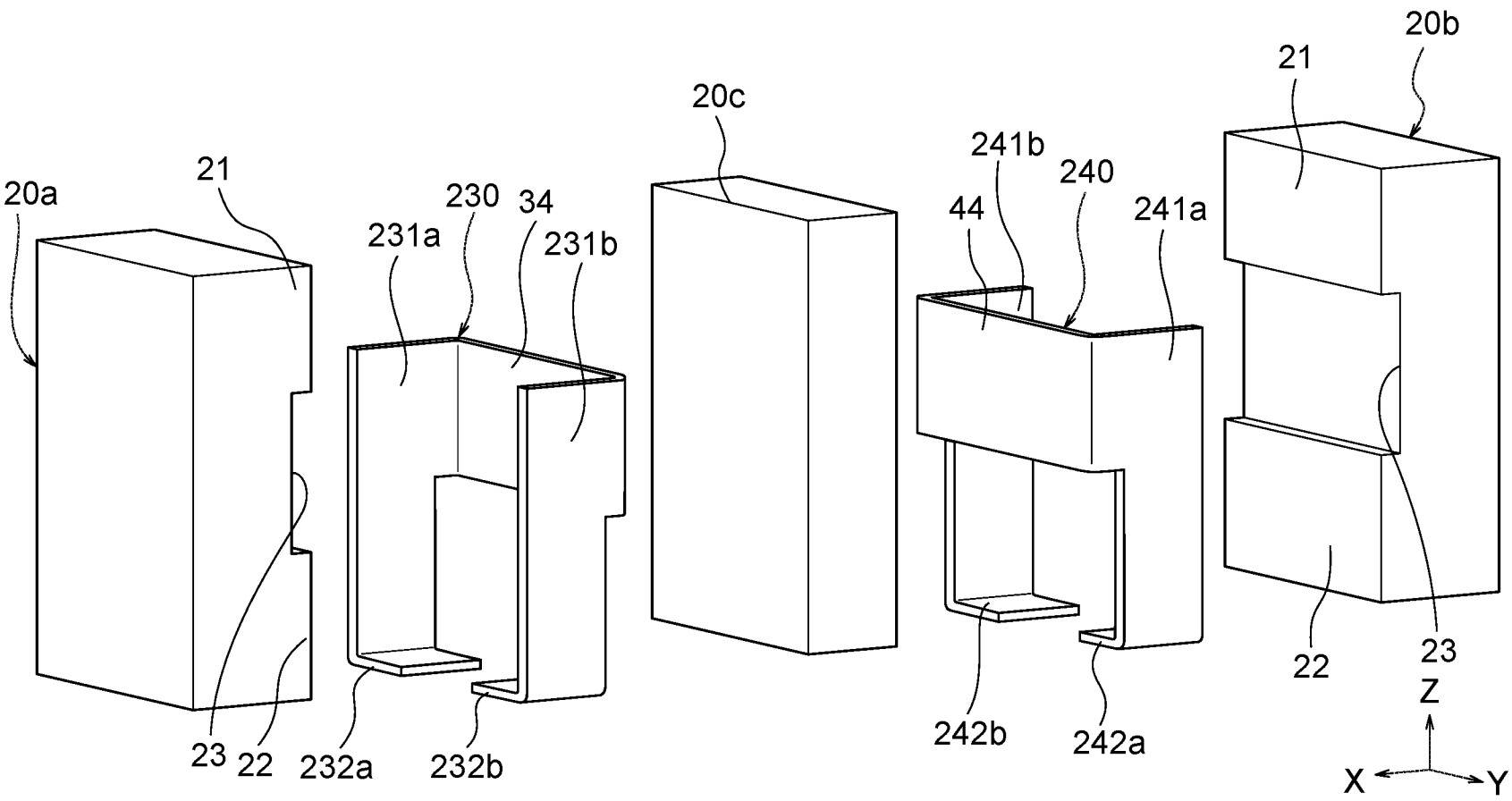
FIG. 6 is an exploded perspective view of the coil device shown in FIG. 5A.

As shown in FIG. 5A, the coil device 210 includes a first coil 230 and a second coil 240. As shown in FIG. 6, the first coil 230 has first lateral parts 231*a* and 231*b*, and the first lateral part 231*a* (231*b*) has a first mountable part 232*a* (232*b*).

As clearly shown in comparison between FIG. 6 and FIG. 4, the first lateral part 231*a* (231*b*) shown in FIG. 6 is provided with neither the first lateral protrusion part 135*b* (135*a*) shown in FIG. 4 nor a component corresponding to the first lateral protrusion part 135*b* (135*a*). Since the first lateral protrusion part 135*a* (135*b*) is not formed, the first concave part 33*a* (33*b*) shown in FIG. 4 is not formed.

In the present embodiment, as shown in FIG. 5A and FIG. 6, the first lateral part 231*a* (231*b*) thereby extends only to the inner side of the end of the second outer leg part 22 on one side in the X-axis direction (negative side in the X-axis direction) at the lower end of the first core 20*a* in the Z-axis direction. The position of the end of the first lateral part 231*a* (231*b*) on one side in the X-axis direction is substantially the same as that of the base of the concave part 23 of the first core 20*a* or is closer to the other side of the base of the concave part 23 of the first core 20*a* in the X-axis direction.

The first mountable part 232*a* (232*b*) is different from the first mountable part 132*a* (132*b*) of Second Embodiment in that the first mountable part 232*a* (232*b*) has a further smaller length in the X-axis direction. In the present embodiment, since the first lateral protrusion part 135*a* (135*b*) is not formed as mentioned above, the first lateral part 231*a* (231*b*) has a small length in the X-axis direction. Thus, the length of the first mountable part 232*a* (232*b*) in the X-axis direction is correspondingly smaller than that of the first mountable part 132*a* (132*b*) of Second Embodiment.

The second coil 240 has second lateral parts 241*a* and 241*b*, and the second lateral part 241*a* (241*b*) has a second mountable part 242*a* (242*b*). The structure of each part of the second lateral part 241*a* (241*b*) is similar to that of the first lateral part 231*a* (231*b*). Thus, their overlapping matters are not explained in detail.

As shown in FIG. 5A and FIG. 6, the second lateral part 241*a* (241*b*) thereby extends only to the inner side of the end of the second outer leg part 22 on the other side in the X-axis direction (positive side in the X-axis direction) at the lower end of the second core 20*b* in the Z-axis direction. The position of the end of the second lateral part 241*a* (241*b*) on the other side in the X-axis direction is substantially the same as that of the base of the concave part 23 of the second core 20*b* or is closer to one side of the base of the concave part 23 of the second core 20*b* in the X-axis direction.

Effects similar to those of Second Embodiment are also obtained in the present embodiment. In addition, since the first lateral protrusion part 135*a* (135*b*) and the second lateral protrusion part 145*a* (145*b*) shown in FIG. 4 are not formed, the present embodiment can effectively prevent the generation of short circuit failure compared to the coil device 110 according to Second Embodiment.

Fourth Embodiment

Except for the following matters, a coil device 310 according to Fourth Embodiment of the present invention is similar to the coil device 210 according to Third Embodiment and demonstrates similar effects. Their overlapping matters are not explained. In the figures, common members are provided with common references.

Figure 8:
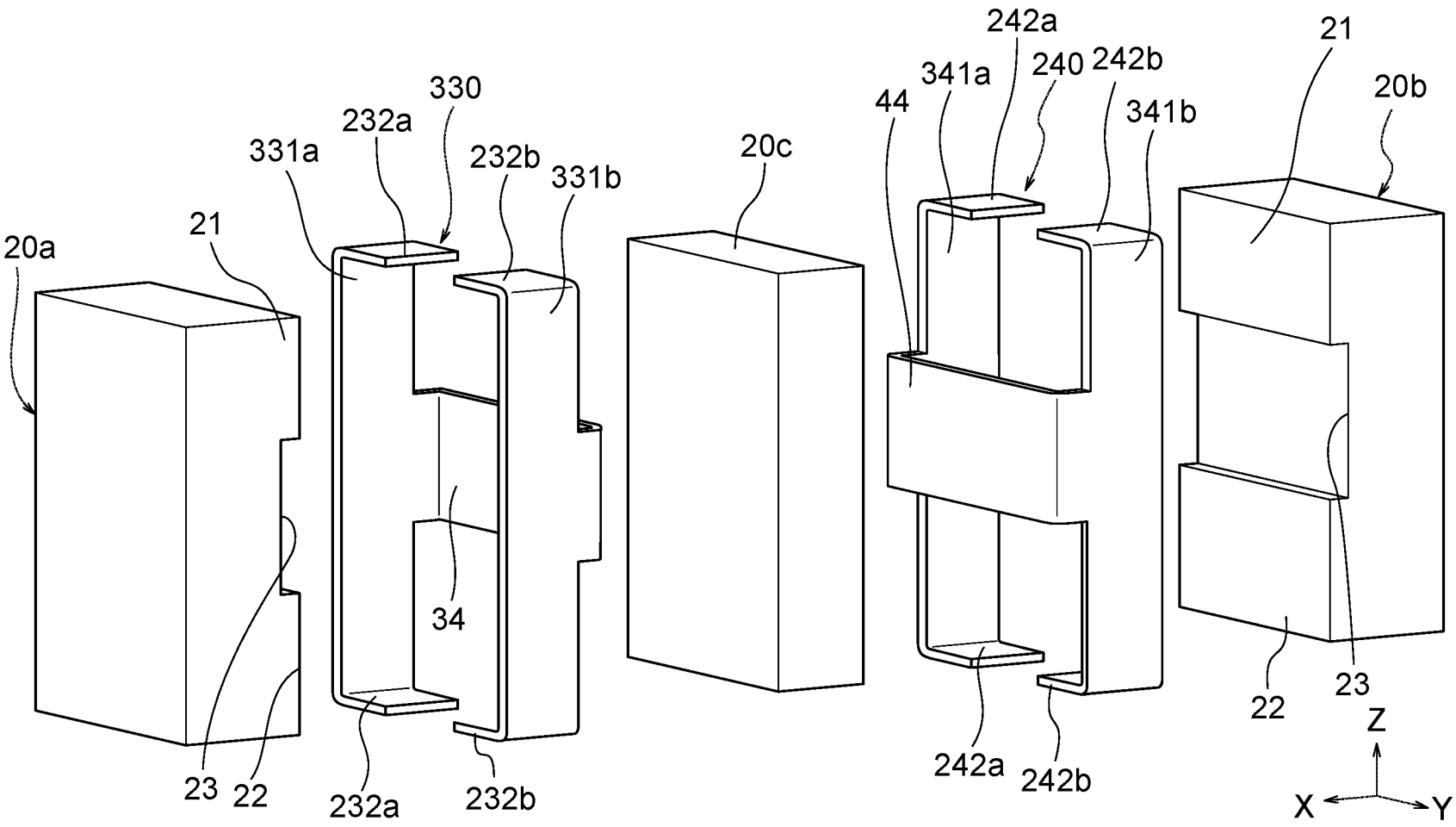
FIG. 8 is an exploded perspective view of the coil device shown in FIG. 7.

As shown in FIG. 7, the coil device 310 includes a first coil 330 and a second coil 340. As shown in FIG. 8, the first coil 330 has first lateral parts 331*a* and 331*b*, and the second coil 340 has second lateral parts 341*a* and 341*b*. The structure of each part of the second lateral part 341*a* (341*b*) is similar to that of the first lateral part 331*a* (331*b*). Thus, their overlapping matters are not explained in detail.

As clearly shown in comparison between FIG. 8 and FIG. 6, the first lateral part 331*a* (331*b*) is different from the first lateral part 231*a* (231*b*) of Third Embodiment in that the first lateral part 331*a* (331*b*) extends not only downward in the Z-axis direction but upward in the Z-axis direction.

A lower part and an upper part of the first lateral part 331*a* (331*b*) in the Z-axis direction with the connection part 34 interposed therebetween have a similar shape. Thus, the overall shape of the coil device 310 is the same even if the coil device 310 is turned upside down from the state of FIG. 9.

The lower part and the upper part of the first lateral part 331*a* (331*b*) in the Z-axis direction with the connection part 34 interposed therebetween have a similar function. Thus, a solder fillet can be formed on the upper part of the first lateral part 331*a* (331*b*) in the Z-axis direction with the connection part 34. The first mountable part 232*a* (232*b*) formed on the same part functions as a connection surface with the mounting board. Thus, the coil device 310 can be connected with the mounting board via the first mountable part 232*a* (232*b*) formed on the same part.

Effects similar to those of Third Embodiment are also obtained in the present embodiment. In the present embodiment, the first lateral part 331*a* (331*b*) extends from the lateral surface to the top surface of the first core 20*a*, and the second lateral part 341*a* (341*b*) extends from the lateral surface to the top surface of the second core 20*b*. Thus, the mounting surface can be formed not only on the bottom surface of the coil device 310 but on the top surface of the coil device 310. Thus, the coil device 310 can be mounted on the mounting board even if the coil device 310 is upside down (the top surface and the bottom surface are reversed), and the coil device 310 is easily mounted.

Fifth Embodiment

Except for the following matters, a coil device 410 according to Fifth Embodiment of the present invention is similar to the coil device 210 according to Third Embodiment and demonstrates similar effects. Their overlapping matters are not explained. In the figures, common members are provided with common references.

Figure 9:
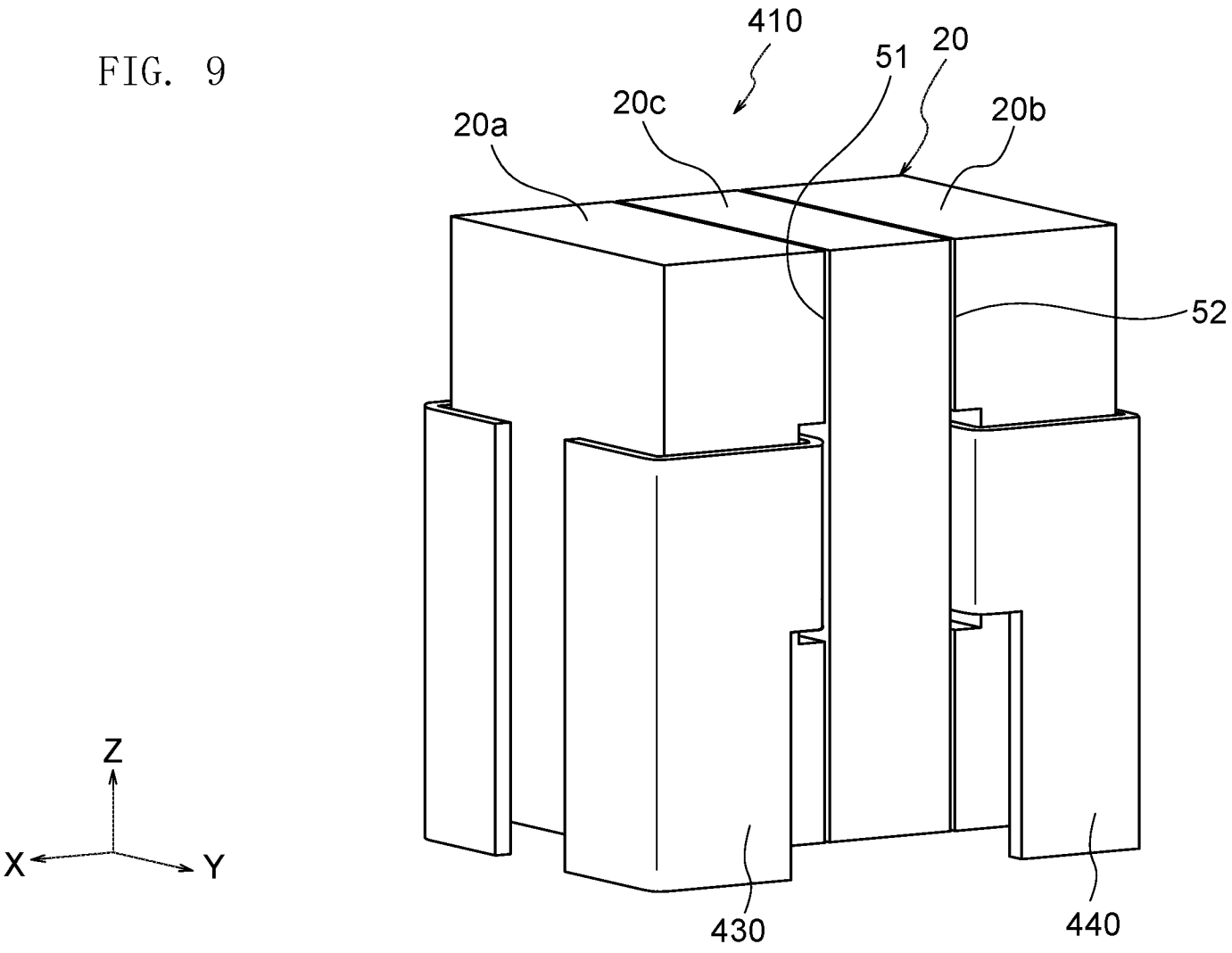
FIG. 9 is a perspective view of a coil device according to Fifth Embodiment of the present invention.
Figure 10:
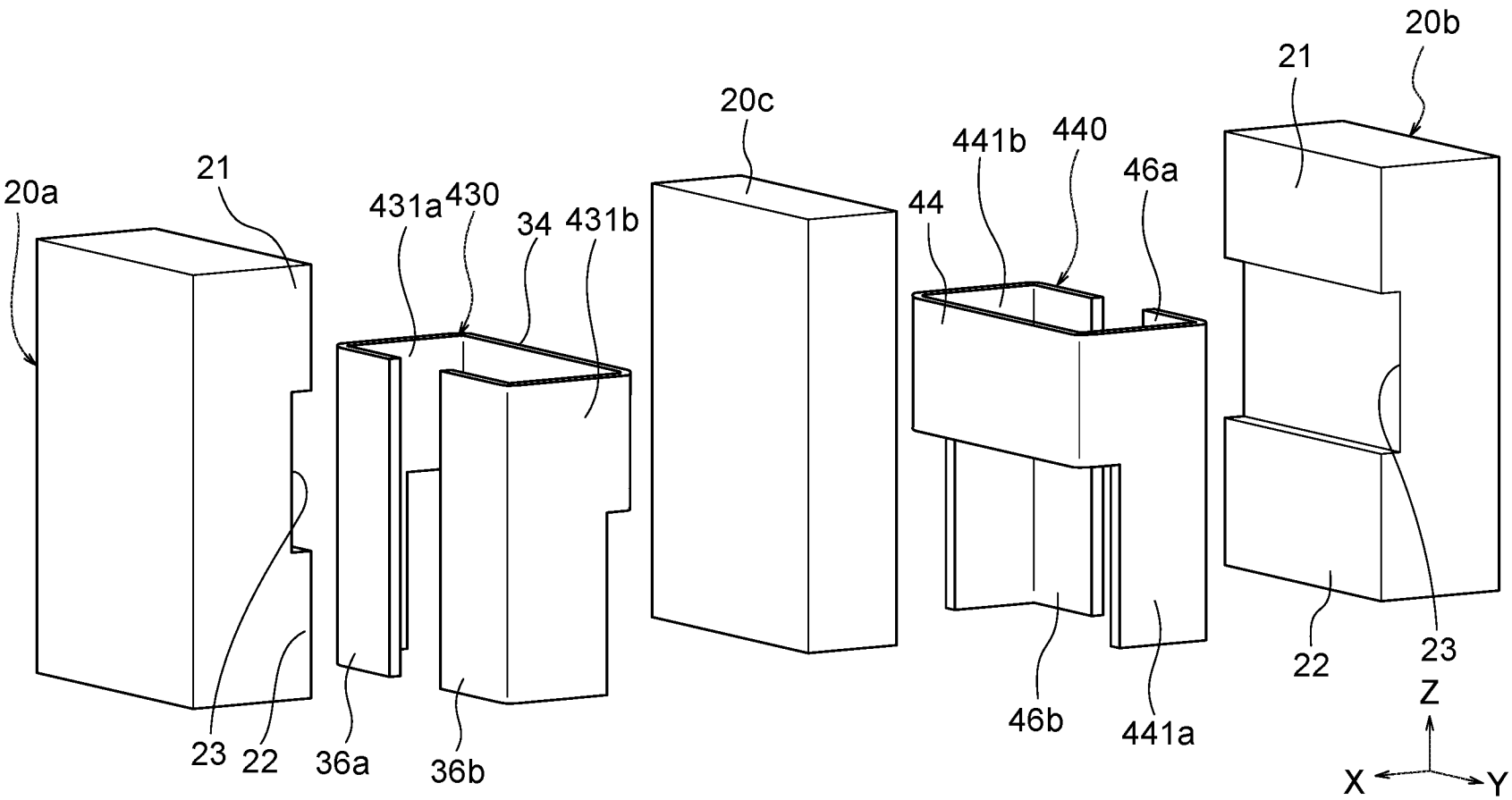
FIG. 10 is an exploded perspective view of the coil device shown in FIG. 9.

As shown in FIG. 9, the coil device 410 includes a first coil 430 and a second coil 440. As shown in FIG. 10, the first coil 430 has first lateral parts 431*a* and 431*b*, and the second coil 440 has second lateral parts 441*a* and 441*b*. The structure of each part of the second lateral part 441*a* (441*b*) is similar to that of the first lateral part 431*a* (431*b*). Thus, their overlapping matters are not explained in detail.

As clearly shown in comparison between FIG. 10 and FIG. 6, the first lateral part 431*a* (431*b*) is different from the first lateral part 231*a* (231*b*) of Third Embodiment in that the first lateral part 431*a* (431*b*) does not have the first mountable part 232*a* (232*b*) but has a first outer end part 36*a* (36*b*), and the second lateral part 441*a* (441*b*) is different from the second lateral part 241*a* (241*b*) of Third Embodiment in that the second lateral part 441*a* (441*b*) does not have the second mountable part 242*a* (242*b*) but has a second outer end part 46*a* (46*b*).

The first outer end part 36*a* (36*b*) has a plate shape (flat shape) parallel to the YZ plane and has a long shape in the Z-axis direction. The first outer end part 36*a* (36*b*) extends downward in the Z-axis direction and is connected with the end of the first lateral part 431*a* (431*b*) (main part of the first lateral part 431*a* (431*b*)) on the other side in the X-axis direction.

As shown in FIG. 9, the first outer end part 36*a* (36*b*) extends substantially in parallel to the end surface of the first core 20*a* on the other side in the X-axis direction, and the first outer end part 36*a* (36*b*) and the end surface of the first core 20*a* on the other side in the X-axis direction are opposed to each other in the X-axis direction. Likewise, the second outer end part 46*a* (46*b*) extends substantially in parallel to the end surface of the second core 20*c* on one side in the X-axis direction, and the second outer end part 46*a* (46*b*) and the end surface of the second core 20*c* on one side in the X-axis direction are opposed to each other in the X-axis direction.

A space may be formed between the first outer end part 36*a* (36*b*) and the end surface of the first core 20*a* on the other side in the X-axis direction, or the first outer end part 36*a* (36*b*) may be in contact with this end surface. A space may be formed between the second outer end part 46*a* (46*b*) and the end surface of the second core 20*b* on one side in the X-axis direction, or the second outer end part 46*a* (46*b*) may be in contact with this end surface.

Effects similar to those of Third Embodiment are also obtained in the present embodiment. In the present embodiment, the first lateral part 431*a* (431*b*) extends from the lateral surface to the end surface of the first core 20*a*, and the second lateral part 441*a* (441*b*) extends from the lateral surface to the end surface of the second core 20*b*. Thus, a solder fillet can be formed on a part of the first lateral part 431*a* (431*b*) located near the end surface of the first core 20*a* (first outer end part 36*a* (36*b*)), and a solder fillet can be formed on a part of the second lateral part 441*a* (441*b*) located near the end surface of the second core 20*b* (second outer end part 46*a* (46*b*)). These solder fillets can increase the mounting strength for the mounting board.

Sixth Embodiment

Except for the following matters, a coil device 510 according to Sixth Embodiment of the present invention is similar to the coil device 210 according to Third Embodiment and demonstrates similar effects. Their overlapping matters are not explained. In the figures, common members are provided with common references.

Figure 11:
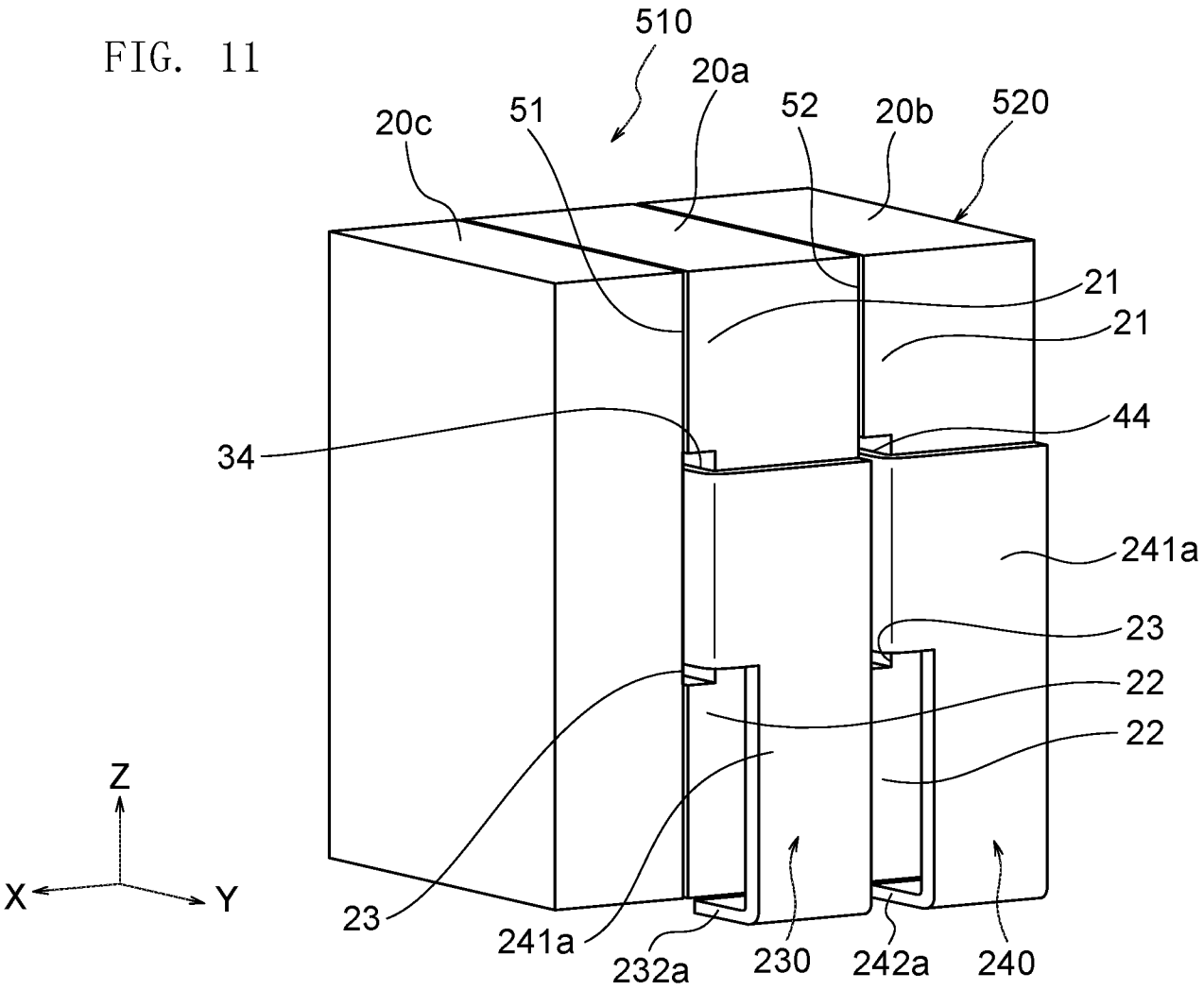
FIG. 11 is a perspective view of a coil device according to Sixth Embodiment of the present invention.

As shown in FIG. 11, the coil device 510 includes a core 520. As clearly shown in comparison between FIG. 11 and FIG. 5A, the arrangement of the cores 20*a*, 20*b*, and 20*c* of the core 520 is different from that of the cores 20*a*, 20*b*, and 20*c* in Third Embodiment. For more detail, the third core 20*c*, the first core 20*a*, and the second core 20*b* of the present embodiment are arranged in this order toward the negative side in the X-axis direction. That is, among the three cores 20*a*, 20*b*, and 20*c* of the present embodiment, the third core 20*c* is disposed at the end on the positive side in the X-axis direction, and the first core 20*a* is interposed by the third core 20*c* and the second core 20*b*.

In the core 520, the direction of the first core 20*a* is different from that of Third Embodiment. For more detail, the first core 20*a* is disposed so that the outer leg part 21 (22) protrudes on the positive side in the X-axis direction, and the direction of the first core 20*a* of the present embodiment is opposite to that of Third Embodiment in the X-axis direction. In the present embodiment, the first core 20*a* and the second core 20*b* thereby have the same direction in the X-axis direction.

In the coil device 510, the direction of the first coil 230 is different from that of Third Embodiment. For more detail, the direction of the first coil 230 is opposite to that of the second coil 240 in the X-axis direction in Third Embodiment as shown in FIG. 5A, but the first coil 230 and the second coil 240 have the same direction in the X-axis direction in the present embodiment as shown in FIG. 11.

As long as the coil 230 (240) is contained in the core 520 (interposed by some of the cores 20*a*, 20*b*, and 20*c*), the arrangement and direction of the cores 20*a*, 20*b*, and 20*c* or the direction of the coil 30 (40) may properly be changed as mentioned above. In this case, effects similar to those of Third Embodiment are also obtained.

Seventh Embodiment

Except for the following matters, a coil device 610 according to Seventh Embodiment of the present invention is similar to the coil device 510 according to Sixth Embodiment and demonstrates similar effects. Their overlapping matters are not explained. In the figures, common members are provided with common references.

Figure 12:
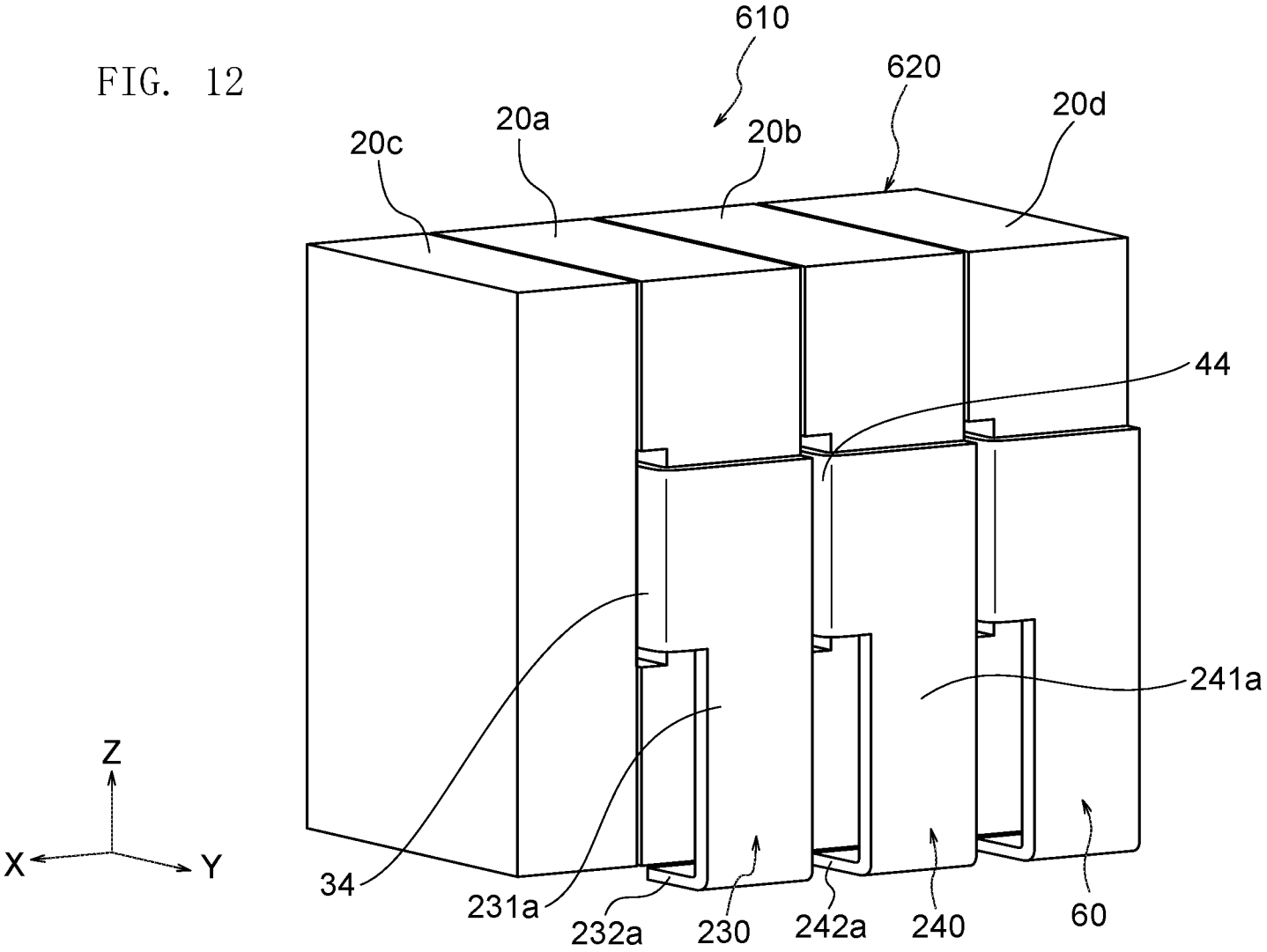
FIG. 12 is a perspective view of a coil device according to Seventh Embodiment of the present invention.

As shown in FIG. 12, the coil device 610 includes a core 620 and a third coil 60. In addition to the first core 20*a*, the second core 20*b*, and the third core 20*c*, the core 620 includes a fourth core 20*d*. The shape of the fourth core 20*d* corresponds to that of the first core 20*a* or the second core 20*b*. In the illustrated example, the fourth core 20*d* and the first core 20*a* or the second core 20*b* have the same shape. The fourth core 20*d* is disposed while facing the same direction as the first core 20*a* and the second core 20*b* in the X-axis direction.

The shape of the third coil 60 corresponds to that of the first coil 30 or the second coil 40. In the illustrated example, the third coil 60 and the first coil 30 or the second coil 40 have the same shape. The third coil 60 is disposed while facing the same direction as the first coil 30 and the second coil 40 in the X-axis direction.

Effects similar to those of Sixth Embodiment are also obtained in the present embodiment. In addition, the present embodiment further includes "n" cores (one core in the illustrated example) corresponding to the first core 20*a* or the second core 20*b* (fourth core 20*d*). For example, the coil device 610 having a high inductance value can be obtained by further adding "n" cores corresponding to the first core 20*a* or the second core 20*b* (fourth core 20*d*) and correspondingly adding "n" coils (one coil in the illustrated example) corresponding to the first coil 230 or the second coil 240 (third coil 60). Even if the number of cores and coils is increased, the coil device 610 can be downsized (space saving) by interposing each of the coils 30, 40, and 60 between the cores 20*a*, 20*b*, 20*c*, and 20*d*.

Eighth Embodiment

Except for the following matters, a coil device 710 according to Eighth Embodiment of the present invention is similar to the coil device 610 according to Seventh Embodiment and demonstrates similar effects. Their overlapping matters are not explained. In the figures, common members are provided with common references.

Figure 13:
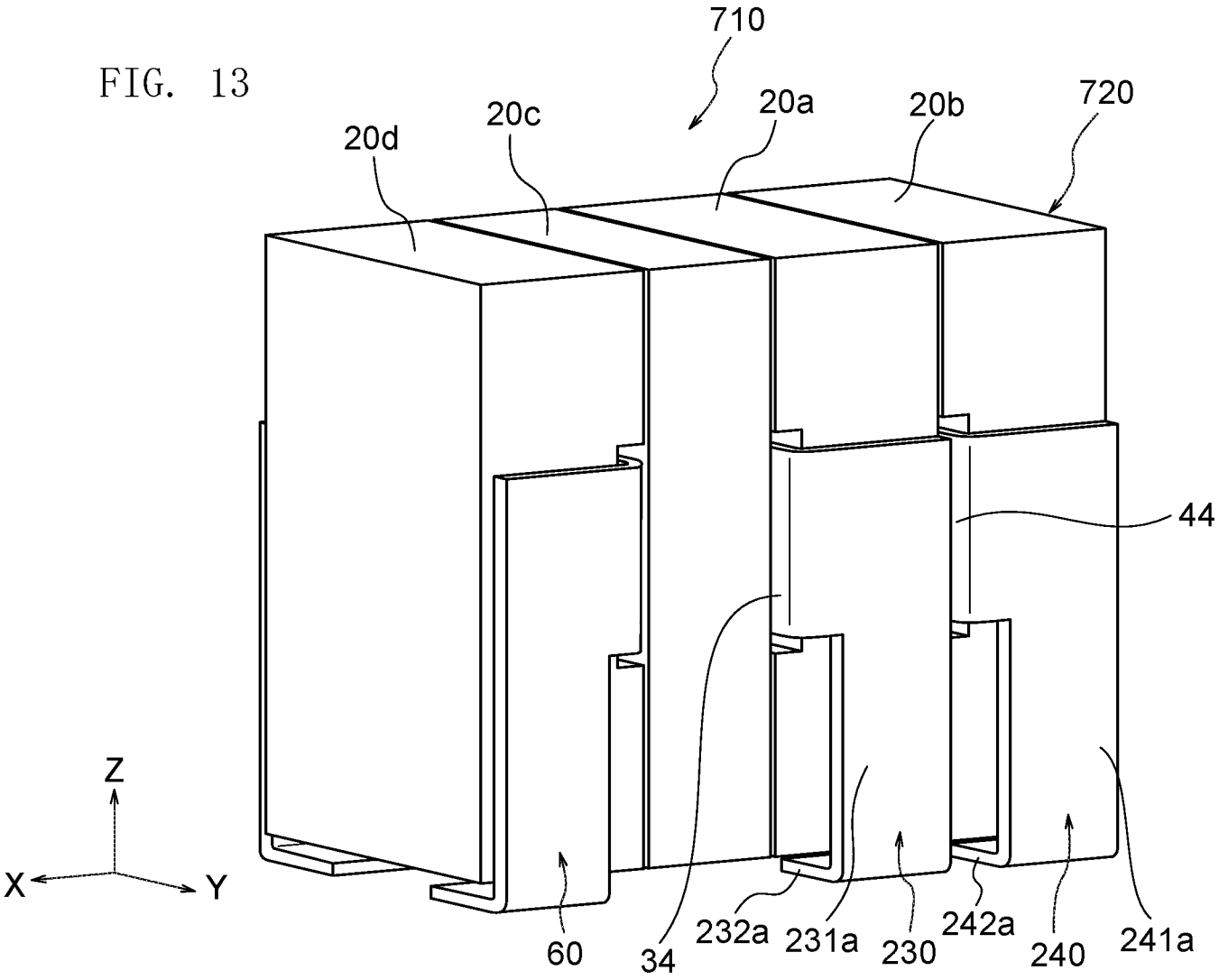
FIG. 13 is a perspective view of a coil device according to Eighth Embodiment of the present invention.

The coil device 710 includes a core 720. As clearly shown in comparison between FIG. 13 and FIG. 12, the core 720 of the present embodiment is different from the core 620 of Seventh Embodiment in that the fourth coil 20*d* of the present embodiment is disposed next to the third core 20*c* while the fourth coil 20*d* of Seventh Embodiment is disposed next to the second coil 20*b*. The fourth core 20*d* of the present embodiment is disposed so that the outer leg part 21 (22) is opposed to the end surface of the third core 20*c* on the other side in the X-axis direction.

The third coil 60 is disposed to be interposed between the third core 20*c* and the fourth core 20*d* arranged next to each other. The third coil 60 is disposed while facing the opposite direction to the first coil 30 and the second coil 40 in the X-axis direction. Incidentally, for example, the coil device 710 is also obtained by disposing the fourth core 20*d* to be next to the second core 20*b* shown in FIG. 5A and further interposing the third coil 60 between the second core 20*b* and the fourth core 20*d* arranged next to each other.

As long as the coils 30, 40, and 60 are arranged in the core 20 (arranged to be interposed by some of the cores 20*a*, 20*b*, 20*c*, and 20*d*), the arrangement and direction of the cores 20*a*, 20*b*, 20*c*, and 20*d* or the direction of the coil 30 (40, 60) may properly be changed. In this case, effects similar to those of Seventh Embodiment are also obtained.

Incidentally, the present invention is not limited to the above-mentioned embodiments and may variously be changed within the scope of the present invention.

In First Embodiment, the first coil 30 and the second coil 40 may have different shapes. This is also the case with Second Embodiment to Eighth Embodiment.

Figure 1C:
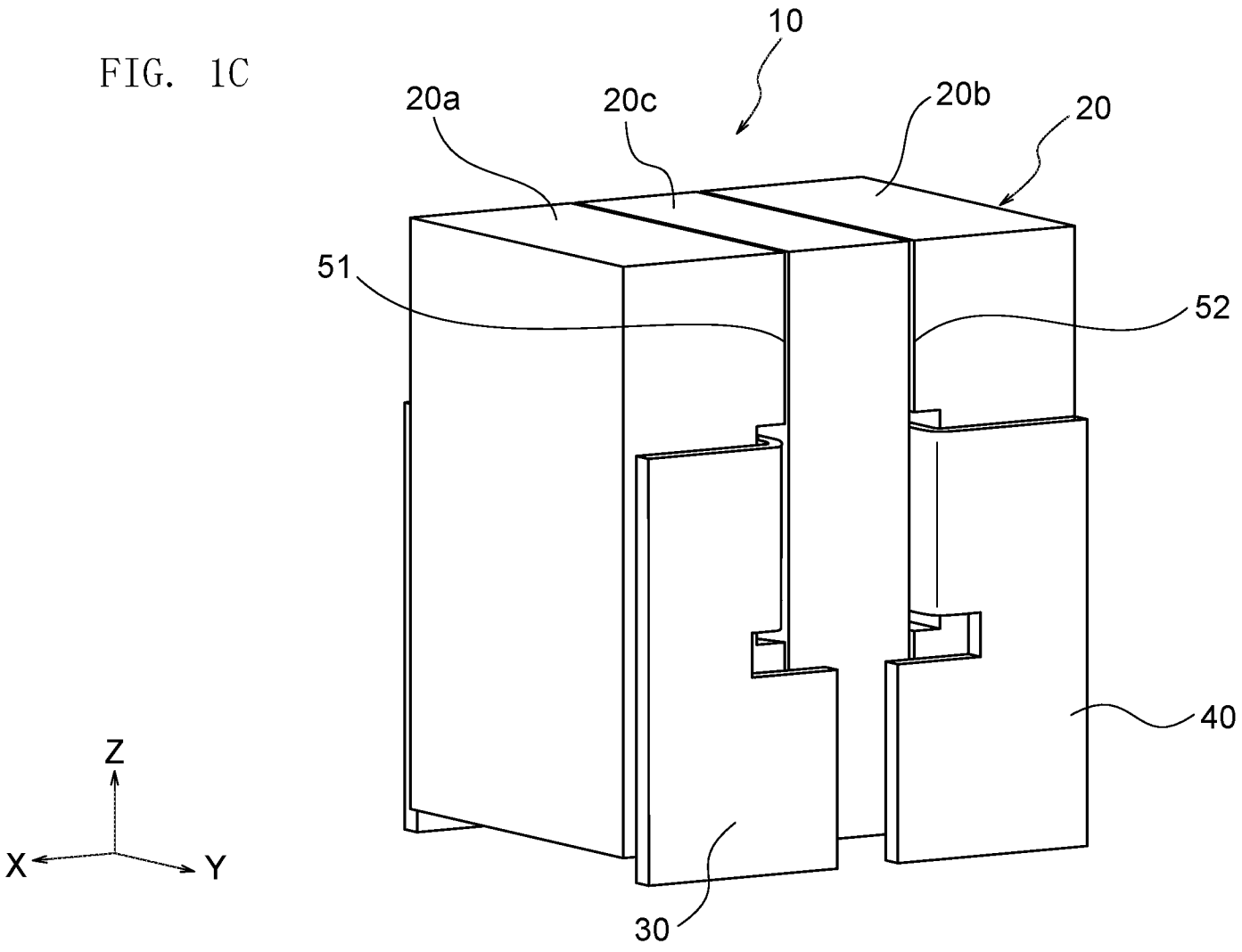
FIG. 1C is a perspective view of a modified example of the coil device shown in FIG. 1A.

In First Embodiment, the first mountable part 32*a* (32*b*) and the second mountable part 42*a* (42*b*) are not indispensable and may not be formed as shown in FIG. 1C. In this case, the structure of the coil 30 (40) can be simplified.

Figure 3B:
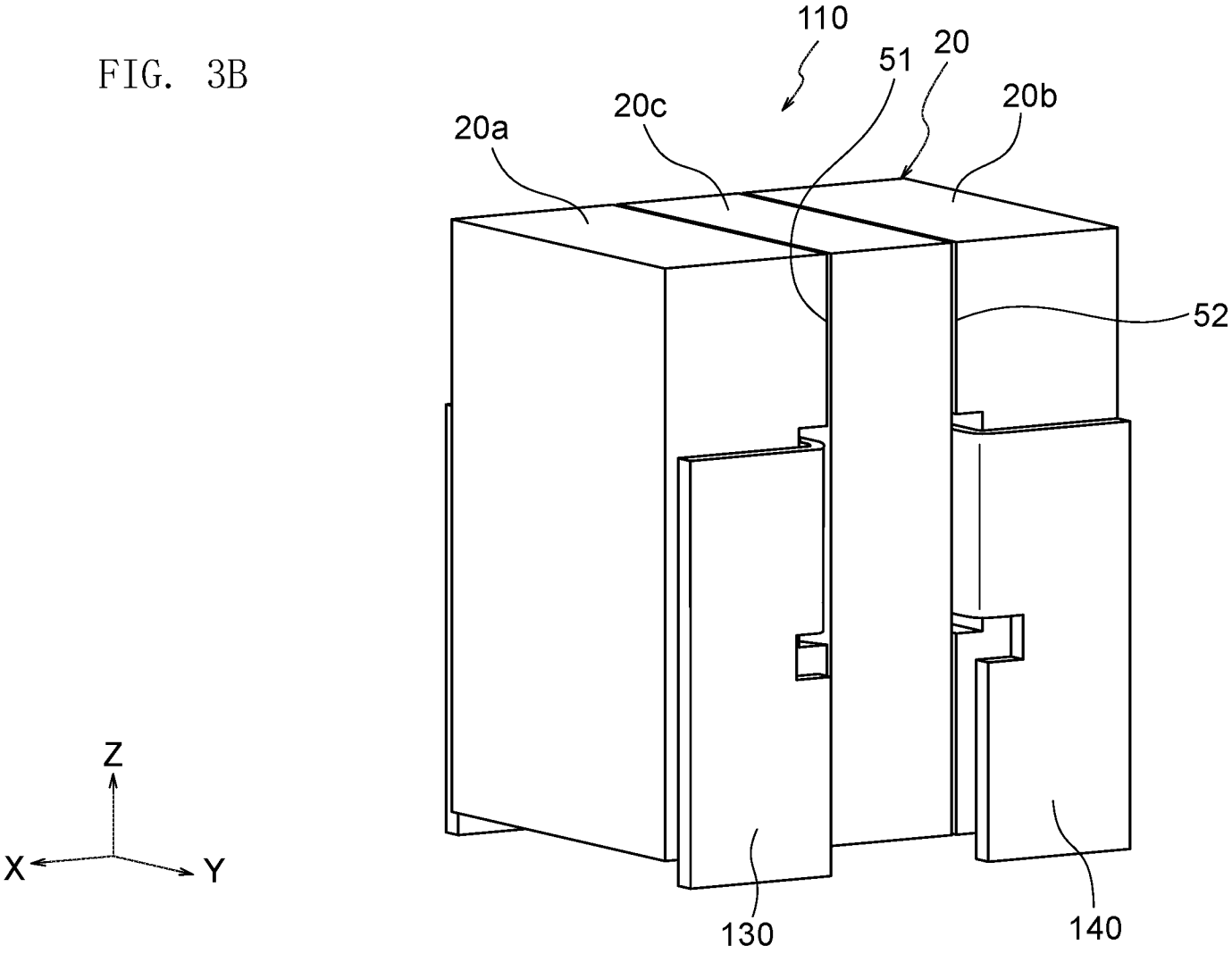
FIG. 3B is a perspective view of a modified example of the coil device shown in FIG. 3A.

In Second Embodiment, the first mountable part 132*a* (132*b*) and the second mountable part 142*a* (142*b*) are not indispensable and may not be formed as shown in FIG. 3B. In this case, the structure of the coil 130 (140) can be simplified.

Figure 5B:
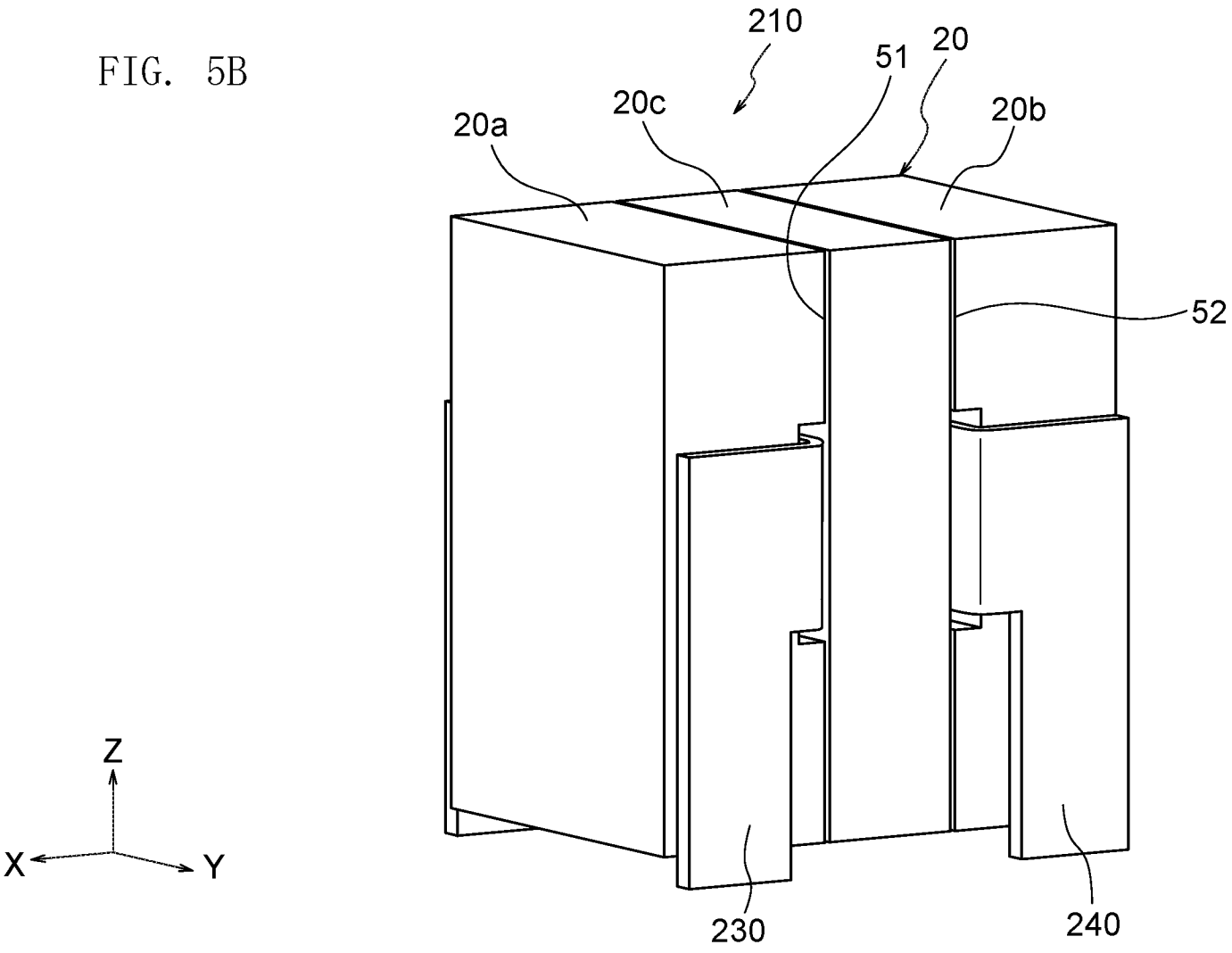
FIG. 5B is a perspective view of a modified example of the coil device shown in FIG. 5A.

In Third Embodiment, the first mountable part 232*a* (232*b*) and the second mountable part 242*a* (242*b*) are not indispensable and may not be formed as shown in FIG. 5B. In this case, the structure of the coil 230 (240) can be simplified.

The technique of Fourth Embodiment may be applied to the coil device 10 of First Embodiment. That is, the first lateral part 31*a* (31*b*) of the first coil 30 shown in FIG. 1A (also, the second lateral part 41*a* (41*b*) of the second coil 40) may extend not only downward above the connection part 34 but upward below the connection part 34 in the Z-axis direction. Likewise, the technique of Fourth Embodiment may be applied to the coil devices of Second Embodiment, Third Embodiment, and Fifth Embodiment to Eighth Embodiment.

The technique of Fifth Embodiment may be applied to the coil device 10 of First Embodiment. That is, the first lateral part 31*a* (31*b*) of the first coil 30 shown in FIG. 1A (also, the second lateral part 41*a* (41*b*) of the second coil 40) may be provided with the first outer end part 36*a* (36*b*) shown in FIG. 10. Likewise, the technique of Fifth Embodiment may be applied to the coil devices of Fourth Embodiment and Sixth Embodiment to Eighth Embodiment.

Sixth Embodiment may employ the coil 30 (40) or so of First Embodiment, Second Embodiment, Fourth Embodiment, or Fifth Embodiment. At this time, the size or so of the coil 30 (40) or so may be changed as necessary. This is the case with Seventh Embodiment and Eighth Embodiment.

In Seventh Embodiment, the coil device 610 is provided with only one core corresponding to the first core 20*a* or the second core 20*b* (fourth core 20*d*), but the number of these cores may be two or more. This is also the case with Eighth Embodiment.

In First Embodiment, the concave part 23 of the first core 20*a* and/or the concave part 23 of the second core 20*b* may be formed to be shifted toward the bottom surface or the top surface of the first core 20*a* or the second core 20*b*. In this structure, the magnetic path of the first coil 30 or the second coil 40 can be changed, and magnetic characteristics of the coil device 30 can be adjusted. This is also the case with Second Embodiment to Eighth Embodiment.

In First Embodiment, any of the first core 20*a*, the second core 20*b*, and the third core 20*c* may be formed from split cores. In this structure, a gap can be formed between the split cores in combining them, and the magnetic coupling between the first coil 30 and the second coil 40 can be adjusted. This is also the case with Second Embodiment to Eighth Embodiment.

In First Embodiment, the first core 20*a* and the second core 20*b* may be made from magnetic material, and the third core 20*c* may be made from nonmagnetic material. When only the third core 20*c* is made from nonmagnetic material, for example, the inductance value of the coil device 10 can be adjusted to a desired value. This is also the case with Second Embodiment to Eighth Embodiment.

In First Embodiment, the core 20 is formed from the first and second cores 20*a* and 20*b* having a U shape and the third core 20*c* having an I shape, but the core 20 may be formed by, for example, combining a H-shaped core and two I-shaped cores. This is also the case with Second Embodiment to Sixth Embodiment. In Seventh Embodiment and Eighth Embodiment, a H-shaped core may be employed.

DESCRIPTION OF THE REFERENCE NUMERICAL

10, 110, 210, 310, 410, 510, 610, 710 . . . coil device
20, 520, 620, 720 . . . core
20*a* . . . first core
20*b* . . . second core
20*c* . . . third core
20*d* . . . fourth core
21 . . . first outer leg part
22 . . . second outer leg part
23 . . . concave part
30, 130, 230, 330, 430 . . . first coil
31*a*, 31*b*, 131*a*, 131*b*, 231*a*, 231*b*, 331*a*, 331*b*, 431*a*, 431*b* . . . first lateral part
32*a*, 32*b*, 132*a*, 132*b*, 232*a*, 232*b* . . . first mountable part
33*a*, 33*b* . . . first concave part
34 . . . first connection part
35*a*, 35*b*, 135*a*, 135*b* . . . first lateral protrusion part
36*a*, 36*b* . . . first outer end part
40, 140, 240, 340, 440 . . . second coil
41*a*, 41*b*, 141*a*, 141*b*, 241*a*, 241*b*, 341*a*, 341*b*, 441*a*, 441*b* . . . second lateral par
42*a*, 42*b*, 142*a*, 142*b*, 242*a*, 242*b* . . . second mountable part
43*a*, 43*b* . . . second concave part
44 . . . second connection part
45*a*, 45*b*, 145*a*, 145*b* . . . second lateral protrusion part
46*a*, 46*b* . . . second outer end part
51 . . . first gap
52 . . . second gap

What is claimed is:

1. A coil device comprising:

a pair of a first core and a second core;

a third core next to the first core or the second core; and a pair of a first coil and a second coil each between any two of the first core, the second core, and the third core next to each other, wherein plate surfaces of the first coil and the second coil are opposed to each other, each of the first coil and the second coil is partly exposed in a lateral direction of the first core, the second core, or the third core, the first coil includes a pair of plate-like first lateral parts and a plate-like first connection part connecting the pair of first lateral parts, and the second coil includes a pair of plate-like second lateral parts and a plate-like second connection part connecting the pair of second lateral parts.

2. The coil device according to claim 1, wherein each of the first connection part and the second connection part is between any two of the first core, the second core, and the third core next to each other.

3. The coil device according to claim 1, wherein at least either of the first lateral parts faces a lateral surface of any of the first core, the second core, and the third core, and at least either of the second lateral parts faces a lateral surface of any of the first core, the second core, and the third core.

4. The coil device according to claim 2, wherein at least either of the first lateral parts faces a lateral surface of any of the first core, the second core, and the third core, and at least either of the second lateral parts faces a lateral surface of any of the first core, the second core, and the third core.

5. The coil device according to claim 3, wherein at least either of the first lateral parts faces lateral surfaces of any two of the first core, the second core, and the third core, and at least either of the second lateral parts faces lateral surfaces of any two of the first core, the second core, and the third core.

6. The coil device according to claim 4, wherein at least either of the first lateral parts faces lateral surfaces of any two of the first core, the second core, and the third core, and at least either of the second lateral parts faces lateral surfaces of any two of the first core, the second core, and the third core.

7. The coil device according to claim 1, wherein at least either of the first lateral parts extends from a lateral surface to a bottom surface of any of the first core, the second core, and the third core, and at least either of the second lateral parts extends from a lateral surface to a bottom surface of any of the first core, the second core, and the third core.

8. The coil device according to claim 2, wherein at least either of the first lateral parts extends from a lateral surface to a bottom surface of any of the first core, the second core, and the third core, and at least either of the second lateral parts extends from a lateral surface to a bottom surface of any of the first core, the second core, and the third core.

9. The coil device according to claim 3, wherein at least either of the first lateral parts extends from a lateral surface to a bottom surface of any of the first core, the second core, and the third core, and at least either of the second lateral parts extends from a lateral surface to a bottom surface of any of the first core, the second core, and the third core.

10. The coil device according to claim 1, wherein at least either of the first lateral parts extends from a lateral surface to a top surface of any of the first core, the second core, and the third core, and at least either of the second lateral parts extends from a lateral surface to a top surface of any of the first core, the second core, and the third core.

11. The coil device according to claim 1, wherein at least either of the first lateral parts extends from a lateral surface to an end surface of any of the first core, the second core, and the third core, and at least either of the second lateral parts extend from a lateral surface to an end surface of any of the first core, the second core, and the third core.

12. The coil device according to claim 1, wherein the first core, the second core, and the third core are formed to be long in a perpendicular direction to a board surface of a mounting board.

13. The coil device according to claim 1, wherein the first core has a first concave part through which the first coil passes, the second core has a second concave part through which the second coil passes, and the first concave part or the second concave part is formed to be shifted toward a bottom surface or a top surface of the first core or the second core.

14. The coil device according to claim 1, further comprising a fourth core having a shape that corresponds to the first core or the second core.

15. The coil device according to claim 2, further comprising a fourth core having a shape that corresponds to the first core or the second core.

16. The coil device according to claim 1, wherein any of the first core, the second core, and the third core includes split cores.

17. The coil device according to claim 1, wherein the first core and the second core are made from magnetic material, and the third core is made from nonmagnetic material.

18. The coil device according to claim 1, wherein the third core is between the first core and the second core, the first coil is between the first core and the third core, the second coil is between the second core and the third core, the plate surfaces of the first coil and the second coil are opposed to each other with the third core interposed therebetween, the first coil is partly exposed in a lateral direction of the first core, and the second coil is partly exposed in a lateral direction of the second core.

19. The coil device according to claim 2, wherein the third core is between the first core and the second core, the first coil is between the first core and the third core, the second coil is between the second core and the third core, the plate surfaces of the first coil and the second coil are opposed to each other with the third core interposed therebetween, the first coil is partly exposed in a lateral direction of the first core, and the second coil is partly exposed in a lateral direction of the second core.

* * * * *